US007289953B2

(12) United States Patent
Yasunaga et al.

(10) Patent No.: US 7,289,953 B2
(45) Date of Patent: Oct. 30, 2007

(54) APPARATUS AND METHOD FOR SPEECH CODING

(75) Inventors: Kazutoshi Yasunaga, Kawasaki (JP); Toshiyuki Morii, Kawasaki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 413 days.

(21) Appl. No.: 11/095,530

(22) Filed: Apr. 1, 2005

(65) Prior Publication Data

US 2005/0171771 A1 Aug. 4, 2005

Related U.S. Application Data

(63) Continuation of application No. 09/807,427, filed as application No. PCT/JP00/05621 on Aug. 23, 2000, now Pat. No. 6,988,065.

(30) Foreign Application Priority Data

Aug. 23, 1999 (JP) ..... 11-235050
Aug. 24, 1999 (JP) ..... 11-236728
Sep. 2, 1999 (JP) ..... 11-248363

(51) Int. Cl.
*G10L 19/12* (2006.01)

(52) U.S. Cl. ..... 704/219; 704/220

(58) Field of Classification Search ..... 704/219, 704/220

See application file for complete search history.

(56) References Cited

U.S. PATENT DOCUMENTS 5,327,519 A 7/1994 Haggvist et al.
5,598,504 A 1/1997 Miyano
5,664,055 A 9/1997 Kroon
5,778,334 A 7/1998 Ozawa et al.
5,864,798 A 1/1999 Miseki et al.

(Continued)

FOREIGN PATENT DOCUMENTS

CA 2167552 7/1996

(Continued)

OTHER PUBLICATIONS

Chen, "A Robust Low-Delay Celp Speech Coder at 16 KB/S," in "Advances in Speech Coding," edited by Atal et al., Kluwer Academic Publishers, Boston, Jan. 1991, pp. 25-35.

(Continued)

*Primary Examiner*—Daniel Abebe
(74) *Attorney, Agent, or Firm*—Greenblum & Bernstein, P.L.C.

(57) ABSTRACT

A speech encoder includes an LPC synthesizer that obtains synthesized speech by filtering an adaptive excitation vector and a stochastic excitation vector stored in an adaptive codebook and in a stochastic codebook using LPC coefficients obtained from input speech. A gain calculator calculates gains of the adaptive excitation vector and the stochastic excitation vector and searches code of the adaptive excitation vector and code of the stochastic excitation vector by comparing distortions between the input speech and the synthesized speech obtained using the adaptive excitation vector and the stochastic excitation vector. A parameter coder performs predictive coding of gains using the adaptive excitation vector and the stochastic excitation vector corresponding to the codes obtained. The parameter coder comprises a prediction coefficient adjuster that adjusts at least one prediction coefficient used for the predictive coding according to at least one state of at least one previous subframe.

6 Claims, 14 Drawing Sheets

U.S. PATENT DOCUMENTS

| | | | | |
|---|---|---|---|---|
| 5,915,234 | A | 6/1999 | Itoh | |
| 6,202,045 | B1 | 3/2001 | Ojala et al. | |
| 6,363,341 | B1 | 3/2002 | Tolhuizen et al. | |
| 6,470,309 | B1 | 10/2002 | McCree et al. | |
| 6,704,702 | B2 | 3/2004 | Oshikiri et al. | |
| 7,146,311 | B1 * | 12/2006 | Uvliden et al. | 704/219 |
| 7,191,120 | B2 * | 3/2007 | Oshikiri et al. | 704/219 |
| 7,194,408 | B2 * | 3/2007 | Uvliden et al. | 704/219 |
| 2003/0093266 | A1 | 5/2003 | Banba | |

FOREIGN PATENT DOCUMENTS

| | | |
|---|---|---|
| EP | 0883107 | 12/1998 |
| JP | 5-011799 | 1/1993 |
| JP | 5-035297 | 2/1993 |
| JP | 6-012097 | 1/1994 |
| JP | 6-083400 | 3/1994 |
| JP | 6-282298 | 10/1994 |
| JP | 8-202398 | 8/1996 |
| JP | 9-062299 | 3/1997 |
| JP | 9-120299 | 5/1997 |
| JP | 9-152897 | 6/1997 |
| JP | 9-190195 | 7/1997 |
| JP | 10-020894 | 1/1998 |
| JP | 10-097295 | 4/1998 |
| JP | 10-232696 | 9/1998 |
| JP | 10-233694 | 9/1998 |
| JP | 10-282998 | 10/1998 |

OTHER PUBLICATIONS

Gerson et al., "Vector Sum Excited Linear Prediction (VSELP) Speech Coding at 8 KBPS," IEEE, Apr. 3, 1990, pp. 461-464.
Kataoka et al., "LSP and Gain Quantization for CS-ACELP Speech Coder," NTT Review, Telecommunications Association, Tokyo, Japan, vol. 8, No. 4, Jul. 1996, pp. 30-35.
Lee et al., "A New Fast Pitch Search Algorithm Using the Abbreviated Correlation Function in CELP Vocoder," Military Communications Conference, 1996, Milcom'96, Conference Proceedings, IEEE, McLean, VA, USA, Oct. 21-24, 1996, pp. 653-657.
Kuo et al., "speech Classification Embedded in Adaptive Codebook Search for CELP Coding," Statistical Signal and Array Processing, Minneapolis, Apr. 27-30, 1993, Proceedings of the International Conference on Accoustics, Speech, and Signal Processing (ICASSP), New York, IEEE, US, vol. 4, Apr. 27, 1993, pp. 147-150.
Yasunaga et al., "ACELP Coding With Dispersed-Pulse Codebook," IEICE Spring Convention Lecture Transactions, Mar. 1997, p. 253.
English Language Abstract of JP 9-062299.
English Language Abstract of JP 9-190195.
English Language Abstract of JP 9-120299.
English Language Abstract of JP 8-202398.
English Language Abstract of JP 6-012097.
English Language Abstract of JP 10-097295.
English Language Abstract of JP 6-282298.
English Language Abstract of JP 10-020894.
English Language Abstract of JP 6-083400.
English Language Abstract of JP 5-35297.
English Language Abstract of JP 10-232696.
English Language Abstract of JP 10-233694.
English Language Abstract of JP 10-282998.
English Language Abstract of JP 9-152897.
"Code-Excited Linear Prediction (CELP): High Quality Speech at Very Low Bit Rates" by M.R. Schroeder et al., Proc. ICASSP 1985.
"Fast CELP coding based on algebraic codes" by J-P. Adoul et al., Proc. IEEE Int. Conf. Acoustics, Speech, Signal Processing, 1987, pp. 1957-1960.
"A comparison of some algebraic structures for CELP coding of speech" by J-P. Adoul et al., Proc. IEEE Int. Conf. Acoustics, Speech, Signal Processing, 1987, pp. 1953-1956.
"Design and Description of CS-ACELP: A Toll Quality 8 kb/s Speech Coder" by Redwan Salami et al., IEEE trans. Speech and Audio Processing, vol. 6, No. 2, Mar. 1998.
U.S. Appl. No. 11/126,171 to Yasunaga et al., filed May 11, 2005.
U.S. Appl. No. 11/095,605 to Yasunaga et al., filed Apr. 1, 2005.
English language Abstract of JP 5-011799.

* cited by examiner

APPARATUS AND METHOD FOR SPEECH CODING

This is a continuation of U.S. application Ser. No. 09/807,427, filed Apr. 20, 2001, now U.S. Pat. No. 6,988,065, which was the National Stage of International Application No. PCT/JP00/05621 filed Aug. 23, 2000, the contents of which are expressly incorporated by reference herein in their entireties. The International Application was not published under PCT Article 21(2) in English.

TECHNICAL FIELD

The present invention relates to an apparatus and method for speech coding used in a digital communication system.

BACKGROUND ART

In the field of digital mobile communication such as cellular telephones, there is a demand for a low bit rate speech compression coding method to cope with an increasing number of subscribers, and various research organizations are carrying forward research and development focused on this method.

In Japan, a coding method called "VSELP" with a bit rate of 11.2 kbps developed by Motorola, Inc. is used as a standard coding system for digital cellular telephones and digital cellular telephones using this system are on sale in Japan since the fall of 1994.

Furthermore, a coding system called "PSI-CELP" with a bit rate of 5.6 kbps developed by NTT Mobile Communications Network, Inc. is now commercialized. These systems are the improved versions of a system called "CELP" (described in "Code Excited Linear Prediction: M. R. Schroeder "High Quality Speech at Low Bit Rates", Proc. ICASSP '85, pp. 937-940).

This CELP system is characterized by adopting a method (A-b-S: Analysis by Synthesis) consisting of separating speech into excitation information and vocal tract information, coding the excitation information using indices of a plurality of excitation samples stored in a codebook, while coding LPC (linear prediction coefficients) for the vocal tract information and making a comparison with input speech taking into consideration the vocal tract information during coding of the excitation information.

In this CELP system, an autocorrelation analysis and LPC analysis are conducted on the input speech data (input speech) to obtain LPC coefficients and the LPC coefficients obtained are coded to obtain an LPC code. The LPC code obtained is decoded to obtain decoded LPC coefficients. On the other hand, the input speech is assigned perceptual weight by a perceptual weighting filter using the LPC coefficients.

Two synthesized speeches are obtained by applying filtering to respective code vectors of excitation samples stored in an adaptive codebook and stochastic codebook (referred to as "adaptive code vector" (or adaptive excitation) and "stochastic code vector" (or stochastic excitation), respectively) using the obtained decoded LPC coefficients.

Then, a relationship between the two synthesized speeches obtained and the perceptual weighted input speech is analyzed, optimal values (optimal gains) of the two synthesized speeches are obtained, the power or the synthesized speeches is adjusted according to the optimal gains obtained and an overall synthesized speech is obtained by adding up the respective synthesized speeches. Then, coding distortion between the overall synthesized speech obtained and the input speech is calculated. In this way, coding distortion between the overall synthesized speech and input speech is calculated for all possible excitation samples and the indexes of the excitation samples (adaptive excitation sample and stochastic excitation sample) corresponding to the minimum coding distortion are identified as the coded excitation samples.

The gains and indexes of the excitation samples calculated in this way are coded and these coded gains and the indexes of the coded excitation samples are sent together with the LPC code to the transmission path. Furthermore, an actual excitation signal is created from two excitations corresponding to the gain code and excitation sample index, these are stored in the adaptive codebook and at the same time the old excitation sample is discarded.

By the way, excitation searches for the adaptive codebook and for the stochastic codebook are generally carried out on a subframe-basis, where subframe is a subdivision of an analysis frame. Coding of gains (gain quantization) is performed by vector quantization (VQ) that evaluates quantization distortion of the gains using two synthesized speeches corresponding to the excitation sample indexes.

In this algorithm, a vector codebook is created beforehand which stores a plurality of typical samples (code vectors) of parameter vectors. Then, coding distortion between the perceptual weighted input speech and a perceptual weighted LPC synthesis of the adaptive excitation vector and of the stochastic excitation vector is calculated using gain code vectors stored in the vector codebook from the following expression 1:

$$En = \sum_{i=0}^{I} (Xi - gn \times Ai - hn \times Si)^2 \qquad \text{Expression 1}$$

where:

$E_n$: Coding distortion when nth gain code vector is used $X_i$: Perceptual weighted speech $A_i$: Perceptual weighted LPC synthesis of adaptive code vector $S_i$: Perceptual weighted LPC synthesis of stochastic code vector $g_n$: Code vector element (gain on adaptive excitation side)

$h_n$: Code vector element (gain on stochastic excitation side)

n: Code vector number i: Excitation data index

I: Subframe length (coding unit of input speech) Then, distortion $E_n$ when each code vector is used by controlling the vector codebook is compared and the number of the code vector with the least distortion is identified as the gain vector code. Furthermore, the number of the code vector with the least distortion is found from among all the possible code vectors stored in the vector codebook and identified to be the vector code.

Expression 1 above seems to require many computational complexity for every n, but since the sum of products on i can be calculated beforehand, it is possible to search n with a small amount of computationak complexity.

On the other hand, by determining a code vector based on the transmitted code of the vector, a speech decoder (decoder) decodes coded data and obtains a code vector.

Moreover, further improvements have been made over the prior art based on the above algorithm. For example, taking advantage of the fact that the human perceptual characteristic to sound intensity is found to have logarithmic scale, power is logarithmically expressed and quantized, and two gains normalized with that power is subjected to VQ. This method is used in the Japan PDC half rate CODEC standard system. There is also a method of coding using inter-frame correlations of gain parameters (predictive coding). This method is used in the ITU-T international standard G.729. However, even these improvements are unable to attain performance to a sufficient degree.

Gain information coding methods using the human perceptual characteristic to sound intensity and inter-frame correlations have been developed so far, providing more efficient coding performance of gain information. Especially, predictive quantization has drastically improved the performance, but the conventional method performs predictive quantization using the same values as those of previous subframes as state values. However, some of the values stored as state values are extremely large (small) and using those values for the next subframe may prevent the next subframe from being quantized correctly, resulting in local abnormal sounds.

DISCLOSURE OF INVENTION

It is an object of the present invention to provide a CELP type speech encoder and encoding method capable of performing speech encoding using predictive quantization with less including local abnormal sounds.

A subject of the present invention is to prevent local abnormal sounds by automatically adjusting prediction coefficients when the state value in a preceding subframe is an extremely large value or extremely small value in predictive quantization.

BEST MODE FOR CARRYING OUT THE INVENTION

With reference now to the attached drawings, embodiments of the present invention will be explained in detail below.

EMBODIMENT 1

Figure 1:
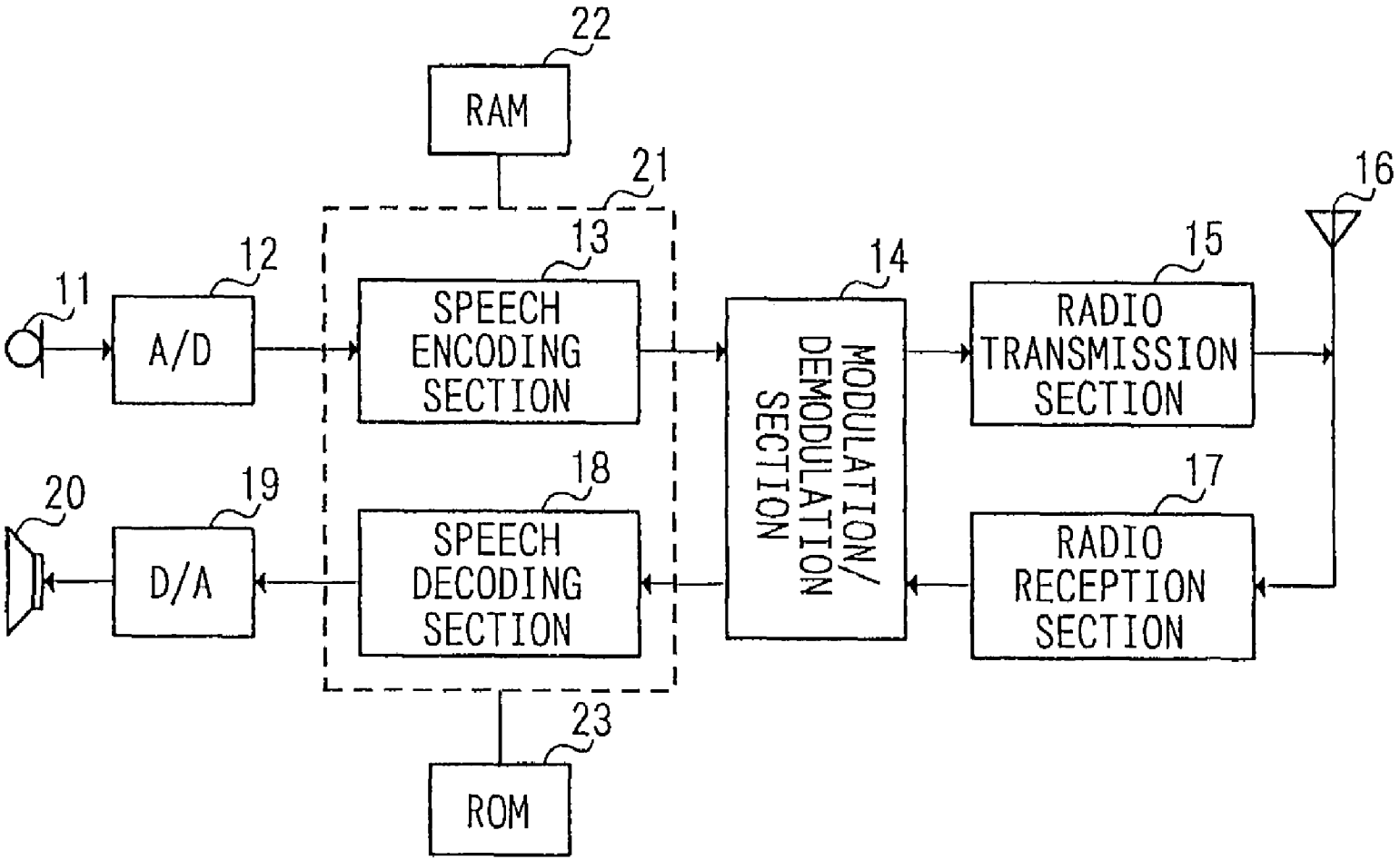
FIG. 1 is a block diagram showing a configuration of a radio communication apparatus equipped with a speech coder/decoder of the present invention.

FIG. 1 is a block diagram showing a configuration of a radio communication apparatus equipped with a speech encoder/decoder according to Embodiments 1 to 3 of the present invention.

On the transmitting side of this radio communication apparatus, a speech is converted to an electric analog signal by speech input apparatus 11 such as a microphone and output to A/D converter 12. The analog speech signal is converted to a digital speech signal by A/D converter 12 and output to speech encoding section 13. Speech encoding section 13 performs speech encoding processing on the digital speech signal and outputs the coded information to modulation/demodulation section 14. Modulation/demodulation section 14 digital-modulates the coded speech signal and sends to radio transmission section 15. Radio transmission section 15 performs predetermined radio transmission processing on the modulated signal. This signal is transmitted via antenna 16. Processor 21 performs processing using data stored in RAM 22 and ROM 23 as appropriate.

On the other hand, on the receiving side of the radio communication apparatus, a reception signal received through antenna 16 is subjected to predetermined radio reception processing by radio reception section 17 and sent to modulation/demodulation section 14. Modulation/demodulation section 14 performs demodulation processing on the reception signal and outputs the demodulated signal to speech decoding section 18. Speech decoding section 18 performs decoding processing on the demodulated signal to obtain a digital decoded speech signal and outputs the digital decoded speech signal to D/A converter 19. D/A converter 19 converts the digital decoded speech signal output from speech decoding section 18 to an analog decoded speech signal and outputs to speech output apparatus 20 such as a speaker. Finally, speech output apparatus 20 converts the electric analog decoded speech signal to a decoded speech and outputs the decoded speech.

Here, speech encoding section 13 and speech decoding section 18 are operated by processor 21 such as DSP using codebooks stored in RAM 22 and ROM 23. These operation programs are stored in ROM 23.

Figure 2:
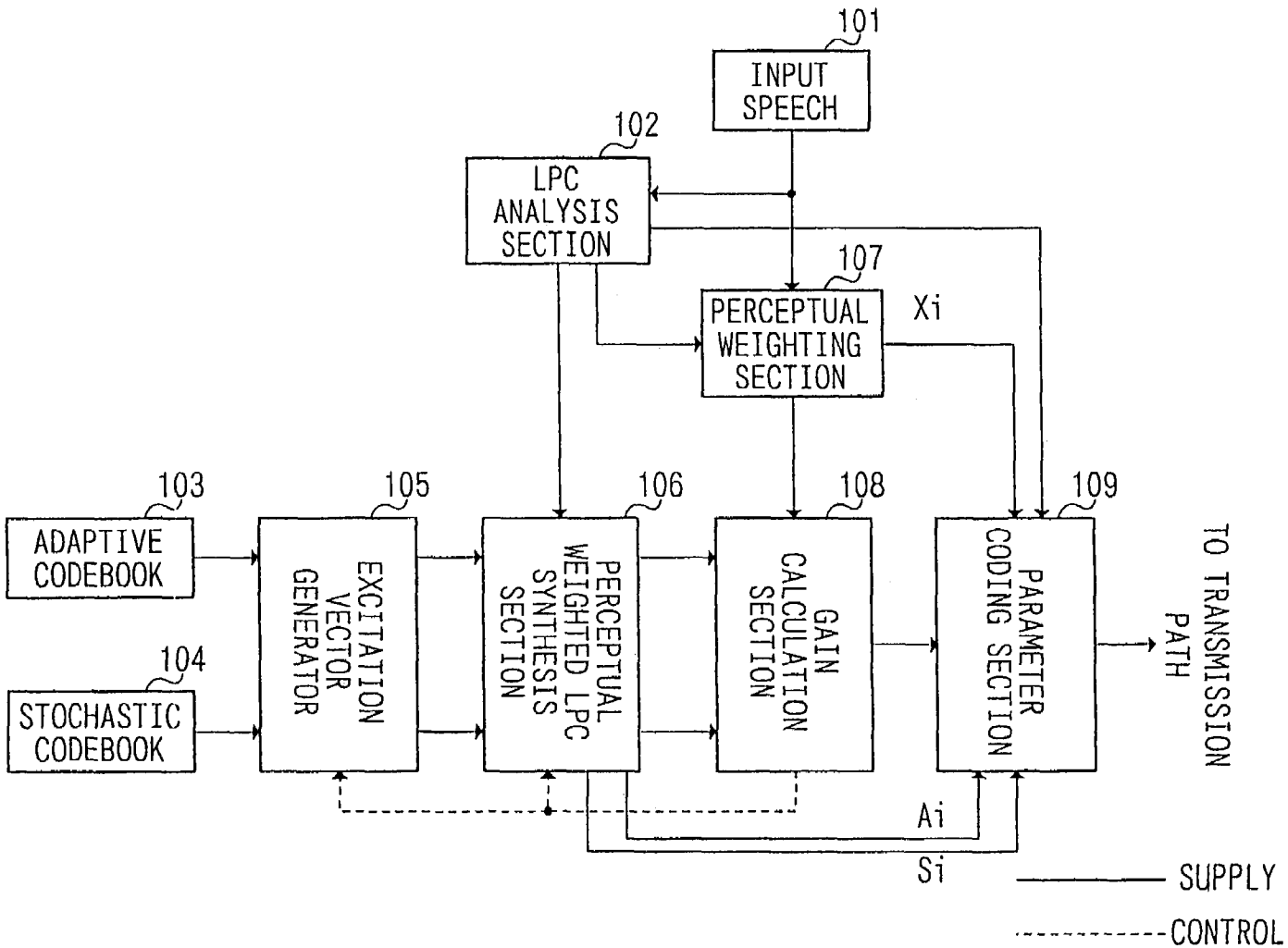
FIG. 2 is a block diagram showing a configuration of the speech encoder according to Embodiment 1 of the present invention.

FIG. 2 is a block diagram showing a configuration of a CELP type speech encoder according to Embodiment 1 of the present invention. This speech encoder is included in speech encoding section 13 shown in FIG. 1. Adaptive codebook 103 shown in FIG. 2 is stored in RAM 22 shown in FIG. 1 and stochastic codebook 104 shown in FIG. 2 is stored in ROM 23 shown in FIG. 1.

In the speech encoder in FIG. 2, LPC analysis section 102 performs an autocorrelation analysis and LPC analysis on speech data 101 and obtains LPC coefficients. Furthermore, LPC analysis section 102 performs encoding of the obtained LPC coefficients to obtain an LPC code. Furthermore, LPC analysis section 102 decodes the obtained LPC code and obtains decoded LPC coefficients. Speech data 101 input is sent to perceptual weighting section 107 and assigned perceptual weight using a perceptual weighting filter using the LPC coefficients above.

Then, excitation vector generator 105 extracts an excitation vector sample (adaptive code vector or adaptive excitation) stored in adaptive codebook 103 and an excitation vector sample (stochastic code vector or adaptive excitation) stored in stochastic codebook 104 and sends their respective code vectors to perceptual weighted LPC synthesis filter 106. Furthermore, perceptual weighted LPC synthesis filter 106 performs filtering on the two excitation vectors obtained from excitation vector generator 105 using the decoded LPC coefficients obtained from LPC analysis section 102 and obtains two synthesized speeches.

Perceptual weighted LPC synthesis filter 106 uses a perceptual weighting filter using the LPC coefficients, high frequency enhancement filter and long-term prediction coefficient (obtained by carrying out a long-term prediction analysis of the input speech) together and thereby performs a perceptual weighted LPC synthesis on their respective synthesized speeches.

Figure 3:
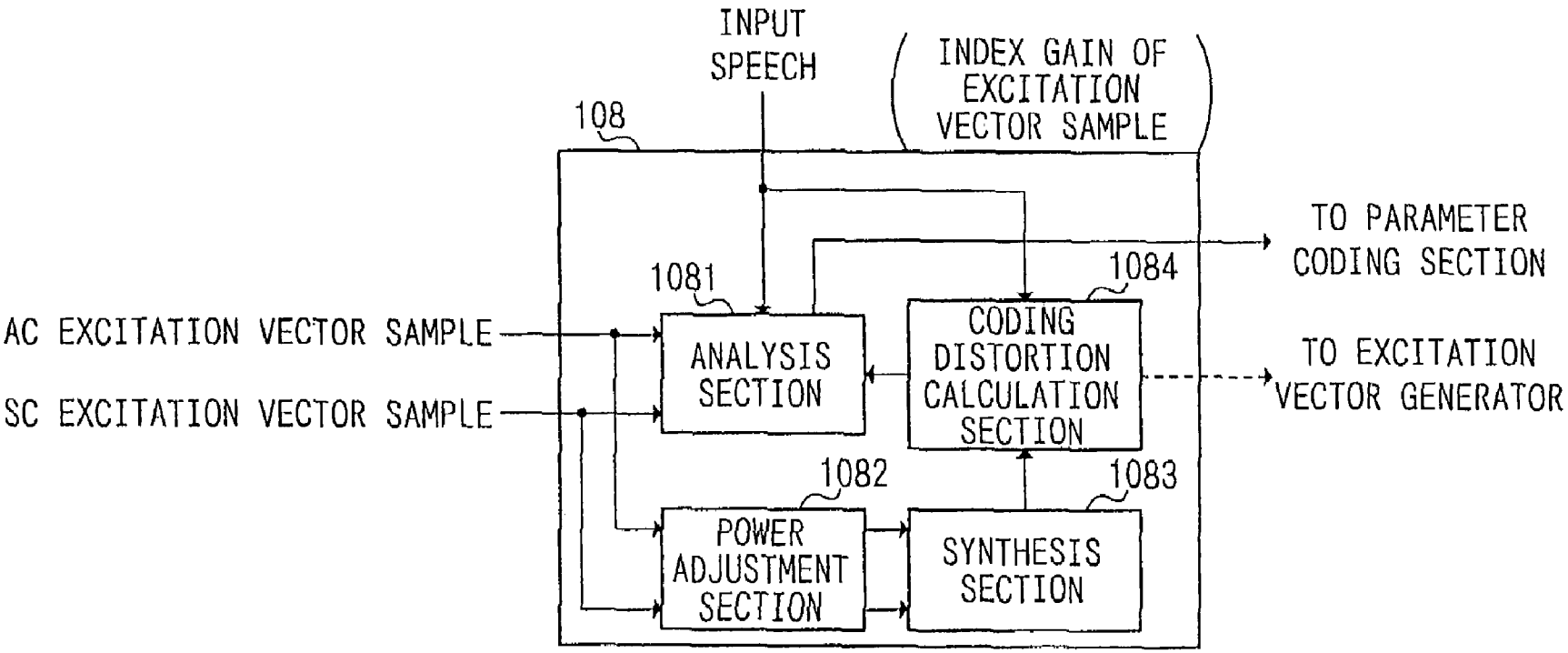
FIG. 3 is a block diagram showing a configuration of a gain calculation section of the speech encoder shown in FIG. 2.

Perceptual weighted LPC synthesis filter 106 outputs the two synthesized speeches to gain calculation section 108. Gain calculation section 108 has a configuration shown in FIG. 3. Gain calculation section 108 sends the two synthesized speeches obtained from perceptual weighted LPC synthesis filter 106 and the perceptual weighted input speech to analysis section 1081 and analyzes the relationship between the two synthesized speeches and input speech to obtain optimal values (optimal gains) for the two synthesized speeches. This optimal gains are output to power adjustment section 1082.

Power adjustment section 1082 adjusts the two synthesized speeches with the optimal gains obtained. The power-adjusted synthesized speeches are output to synthesis section 1083 and added up there to become an overall synthesized speech. This overall synthesized speech is output to coding distortion calculation section 1084. Coding distortion calculation section 1084 finds coding distortion between the overall synthesized speech obtained and input speech.

Coding distortion calculation section 1084 controls excitation vector generator 105 to output all possible excitation vector samples of adaptive codebook 103 and of stochastic codebook 104, finds coding distortion between the overall synthesized speech and input speech on all excitation vector samples and identifies the respective indexes of the respective excitation vector samples corresponding to the minimum coding distortion.

Then, analysis section 1081 sends the indexes of the excitation vector samples, the two perceptual weighted LPC synthesized excitation vectors corresponding to the respective indexes and input speech to parameter coding section 109.

Parameter coding section 109 obtains a gain code by coding the gains and sends the LPC code, indexes of the excitation vector samples all together to the transmission path. Furthermore, parameter coding section 109 creates an actual excitation vector signal from the gain code and two excitation vectors corresponding to the respective indexes and stores the excitation vector into the adaptive codebook 103 and at the same time discards the old excitation vector sample in the adaptive codebook. By the way, an excitation vector search for the adaptive codebook and an excitation vector search for the stochastic codebook are generally performed on a subframe basis, where "subframe" is a subdivision of an processing frame (analysis frame).

Figure 4:
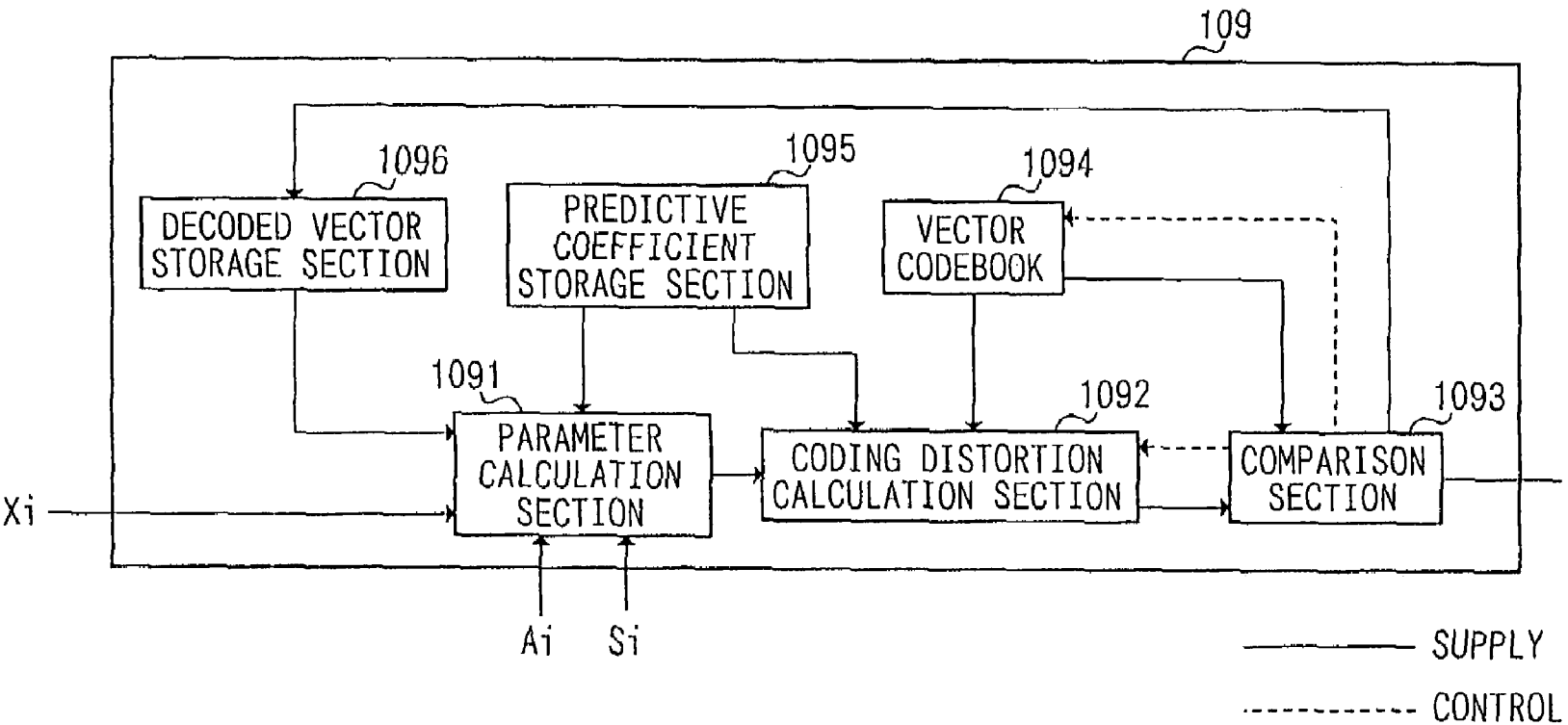
FIG. 4 is a block diagram showing a configuration of a parameter coding section of the speech encoder shown in FIG. 2.

Here, the operation of gain encoding of parameter coding section 109 of the speech encoder in the above configuration will be explained. FIG. 4 is a block diagram showing a configuration of the parameter coding section of the speech encoder of the present invention.

In FIG. 4, perceptual weighted input speech ($X_i$), perceptual weighted LPC synthesized adaptive code vector ($A_i$) and perceptual weighted LPC synthesized stochastic code vector ($S_i$) are sent to parameter calculation section 1091. Parameter calculation section 1091 calculates parameters necessary for a coding distortion calculation. The parameters calculated by parameter calculation section 1091 are output to coding distortion calculation section 1092 and the coding distortion is calculated there. This coding distortion is output to comparison section 1093. Comparison section 1093 controls coding distortion calculation section 1092 and vector codebook 1094 to obtain the most appropriate code from the obtained coding distortion and outputs the code vector (decoded vector) obtained from vector codebook 1094 based on this code to decoded vector storage section 1096 and updates decoded vector storage section 1096.

Prediction coefficients storage section 1095 stores prediction coefficients used for predictive coding. This prediction coefficients are output to parameter calculation section 1091 and coding distortion calculation section 1092 to be used for parameter calculations and coding distortion calculations. Decoded vector storage section 1096 stores the states for predictive coding. These states are output to parameter calculation section 1091 to be used for parameter calculations. Vector codebook 1094 stores code vectors.

Then, the algorithm of the gain coding method according to the present invention will be explained.

Vector codebook 1094 is created beforehand, which stores a plurality of typical samples (code vectors) of quantization target vectors. Each vector consists of three elements; AC gain, logarithmic value of SC gain, and an adjustment coefficient for prediction coefficients of logarithmic value of SC gain.

This adjustment coefficient is a coefficient to adjust prediction coefficients according to a states of previous subframes. More specifically, when a state of a previous subframe is an extremely large value or an extremely small value, this adjustment coefficient is set so as to reduce that influence. It is possible to calculate this adjustment coefficient using a training algorithm developed by the present inventor, et al. using many vector samples. Here, explanations of this training algorithm are omitted.

For example, a large value is set for the adjustment coefficient in a code vector frequently used for voiced sound segments. That is, when a same waveform is repeated in series, the reliability of the states of the previous subframes is high, and therefore a large adjustment coefficient is set so that the large prediction coefficients of the previous subframes can be used. This allows more efficient prediction.

On the other hand, a small value is set for the adjustment coefficient in a code vector less frequently used at the onset segments, etc. That is, when the waveform is quite different from the previous waveform, the reliability of the states of the previous subframes is low (the adaptive codebook is considered not to function), and therefore a small value is set for the adjustment coefficient so as to reduce the influence of the prediction coefficients of the previous subframes. This prevents any detrimental effect on the next prediction, making it possible to implement satisfactory predictive coding.

In this way, adjusting prediction coefficients according to code vectors of states makes it possible to further improve the performance of predictive coding so far.

Prediction coefficients for predictive coding are stored in prediction coefficient storage section 1095. These prediction coefficients are prediction coefficients of MA (Moving Average) and two types of prediction coefficients, AC and SC, are stored by the number corresponding to the prediction order. These prediction coefficients are generally calculated through training based on a huge amount of sound database beforehand. Moreover, values indicating silent states are stored in decoded vector storage section 1096 as the initial values.

Then, the coding method will be explained in detail below. First, a perceptual weighted input speech ($X_i$), perceptual weighted LPC synthesized adaptive code vector ($A_i$) and perceptual weighted LPC synthesized stochastic code vector ($S_i$) are sent to parameter calculation section 1091 and furthermore the decoded vector (AC, SC, adjustment coefficient) stored in decoded vector storage section 1096 and the prediction coefficients (AC, SC) stored in prediction coefficient storage section 1095 are sent. Parameters necessary for a coding distortion calculation are calculated using these values and vectors.

A coding distortion calculation by coding distortion calculation section 1092 is performed according to expression 2 below:

$$En = \sum_{i=0}^{I} (Xi - Gan \times Ai - Gsn \times Si)^2 \quad \text{Expression 2}$$

where:

$G_{an}$, $G_{sn}$: Decoded gain $E_n$: Coding distortion when nth gain code vector is used $X_i$: Perceptual weighted speech $A_i$: Perceptual weighted LPC synthesized adaptive code vector $S_i$: Perceptual weighted LPC synthesized stochastic code vector n: Code vector number i: Excitation vector index I: Subframe length (coding unit of input speech)

In order to reduce the amount of calculation, parameter calculation section 1091 calculates the part independent of the code vector number. What should be calculated are correlations between three synthesized speeches ($X_i$, $A_i$, $S_i$) and powers. These calculations are performed according to expression 3 below:

$$Dxx = \sum_{i=0}^{I} Xi \times Xi \quad \text{Expression 3}$$

-continued $$Dxa = \sum_{i=0}^{I} Xi \times Ai \times 2$$

$$Dxs = \sum_{i=0}^{I} Xi \times Si \times 2$$

$$Daa = \sum_{i=0}^{I} Ai \times Ai$$

$$Das = \sum_{i=0}^{I} Ai \times Si \times 2$$

$$Dss = \sum_{i=0}^{I} Si \times Si$$

where:

$D_{xx}$, $D_{xa}$, $D_{xs}$, $D_{aa}$, $D_{as}$, $D_{ss}$: Correlation value between synthesized speeches, power $X_i$: Perceptual weighted speech $A_i$: Perceptual weighted LPC synthesized adaptive code vector $S_i$: Perceptual weighted LPC synthesized stochastic code vector n: Code vector number i: Excitation vector index I: Subframe length (coding unit of input speech)

Furthermore, parameter calculation section 1091 calculates three predictive values shown in expression 4 below using past code vectors stored in decoded vector storage section 1096 and prediction coefficients stored in prediction coefficient storage section 1095.

$$Pra = \sum_{m=0}^{M} \alpha m \times Sam \quad \text{Expression 4}$$

$$Prs = \sum_{m=0}^{M} \beta m \times Scm \times Ssm$$

$$Psc = \sum_{m=0}^{M} \beta m \times Scm$$

where:

$P_{ra}$: Predictive value (AC gain)

$P_{rs}$: Predictive value (SC gain)

$P_{sc}$: Predictive value (prediction coefficient)

$\alpha_m$: Prediction coefficient (AC gain, fixed value)

$\beta_m$: Prediction coefficient (SC gain, fixed value)

$S_{am}$: State (element of past code vector, AC gain)

$S_{sm}$: State (element of past code vector, SC gain)

$S_{cm}$: State (element of past code vector, SC prediction coefficient adjustment coefficient)

m: Predictive index

M: Prediction order

As is apparent from expression 4 above, with regard to $P_{rs}$ and $P_{sc}$, adjustment coefficients are multiplied unlike the conventional art. Therefore, regarding the predictive value and prediction coefficient of an SC gain, when a value of a state in the previous subframe is extremely large or extremely small, it is possible to alleviate the influence (reduce the influence) by means of the adjustment coefficient. That is, it is possible to adaptively change the predictive value and prediction coefficients of the SC gain according to the states.

Then, coding distortion calculation section 1092 calculates coding distortion using the parameters calculated by parameter calculation section 1091, the prediction coefficients stored in prediction coefficient storage section 1095 and the code vectors stored in vector codebook 1094 according to expression 5 below:

$$En = Dxx + (Gan)^2 \times Daa + (Gsn)^2 \times Dss - Gan \times Dxa - Gsn \times Dxs + Gan \times Gsn \times Das \quad \text{Expression 5}$$

$$Gan = Pra + (1 - Pac) \times Can$$

$$Gsn = 10\hat{}\{Prs + (1 - Psc) \times Csn\}$$

where:

$E_n$: Coding distortion when nth gain code vector is used $D_{xx}$, $D_{xa}$, $D_{xs}$, $D_{aa}$, $D_{as}$, $D_{ss}$: Correlation value between synthesized speeches, power $G_{an}$, $G_{sn}$: Decoded gain $P_{ra}$: Predictive value (AC gain)

$P_{rs}$: Predictive value (SC gain)

$P_{ac}$: Sum of prediction coefficients (fixed value)

$P_{sc}$: Sum of prediction coefficients (calculated by expression 4 above)

$C_{an}$, $C_{sn}$, $C_{cn}$: Code vector, $C_{cn}$ is a prediction coefficient adjustment coefficient, but not used here n: Code vector number $D_{xx}$ is actually independent of code vector number n, and the addition of $D_{xx}$ can be omitted.

Then, comparison section 1093 controls vector codebook 1094 and coding distortion calculation section 1092 and finds the code vector number corresponding to the minimum coding distortion calculated by coding distortion calculation section 1092 from among a plurality of code vectors stored in vector codebook 1094 and identifies this as the gain code. Furthermore, the content of decoded vector storage section 1096 is updated using the gain code obtained. The update is performed according to expression 6 below:

$$Sam=Sam-1(m=M\sim1),Sa0=CaJ$$

$$Ssm=Ssm-1(m=M\sim1),Ss0=CsJ$$

$$SCm=SSm-1(m=M\cdot1),Sc0=CcJ \quad \text{Expression 6}$$

where:

$S_{am}$, $S_{sm}$, $S_{cm}$: State vector (AC, SC, prediction coefficient adjustment coefficient)

m: Predictive index

M: Prediction order

J: Code obtained from comparison section

As is apparent from Expression 4 to Expression 6, in this embodiment, decoded vector storage section 1096 stores state vector $S_{cm}$ and prediction coefficients are adaptively controlled using these prediction coefficient adjustment coefficients.

Figure 5:
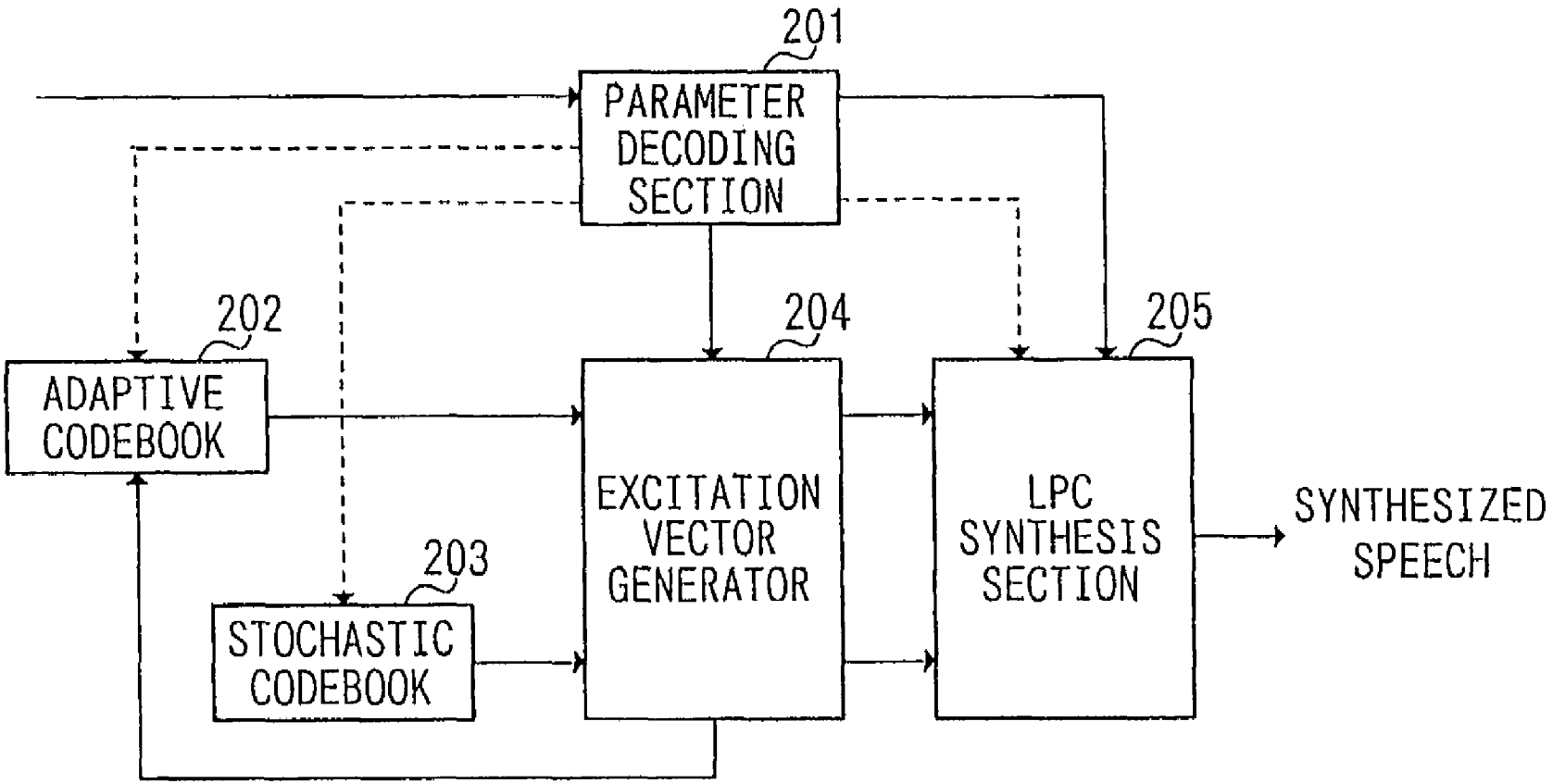
FIG. 5 is a block diagram showing a configuration of a speech decoder for decoding speech data coded by the speech encoder according to Embodiment 1 of the present invention.

FIG. 5 shows a block diagram showing a configuration of the speech decoder according to this embodiment of the present invention. This speech decoder is included in speech decoding section 18 shown in FIG. 1. By the way, adaptive codebook 202 in FIG. 5 is stored in RAM 22 in FIG. 1 and stochastic codebook 203 in FIG. 5 is stored in ROM 23 in FIG. 1.

In the speech decoder in FIG. 5, parameter decoding section 201 obtains the respective excitation vector sample codes of respective excitation vector codebooks (adaptive codebook 202, stochastic codebook 203), LPC codes and gain codes from the transmission path. Parameter decoding section 201 then obtains decoded LPC coefficients from the LPC code and obtains decoded gains from the gain code.

Then, excitation vector generator 204 obtains decoded excitation vectors by multiplying the respective excitation vector samples by the decoded gains and adding up the multiplication results. In this case, the decoded excitation vector obtained are stored in adaptive codebook 204 as excitation vector samples and at the same time the old excitation vector samples are discarded. Then, LPC synthesis section 205 obtains a synthesized speech by filtering the decoded excitation vector with the decoded LPC coefficients.

The two excitation codebooks are the same as those included in the speech encoder in FIG. 2 (reference numerals 103 and 104 in FIG. 2) and the sample numbers (codes for the adaptive codebook and codes for the stochastic codebook) to extract the excitation vector samples are supplied from parameter decoding section 201.

Thus, the speech encoder of this embodiment can control prediction coefficients according to each code vector, providing more efficient prediction more adaptable to local characteristic of speech, thus making it possible to prevent detrimental effects on prediction in the non-stationary segment and attain special effects that have not been attained by conventional arts.

EMBODIMENT 2

As described above, the gain calculation section in the speech encoder compares synthesized speeches and input speeches of all possible excitation vectors in the adaptive codebook and in the stochastic codebook obtained from the excitation vector generator. At this time, two excitation vectors (adaptive codebook vector and stochastic codebook vector) are generally searched in an open-loop for the consideration of the amount of computational complexity. This will be explained with reference to FIG. 2 below.

In this open-loop search, excitation vector generator 105 selects excitation vector candidates only from adaptive codebook 103 one after another, makes perceptual weighted LPC synthesis filter 106 function to obtain a synthesized speech and send to gain calculation section 108, compares the synthesized speech and input speech and selects an optimal code of adaptive codebook 103.

Then, excitation vector generator 105 fixes the code of adaptive codebook 103 above, selects the same excitation vector from adaptive codebook 103 and selects excitation vectors corresponding to gain calculation section 108 one after another from stochastic codebook 104 and sends to perceptual weighted LPC synthesis filter 106. Gain calculation section 108 compares the sum of both synthesized speeches and the input speech to determine the code of stochastic codebook 104.

When this algorithm is used, the coding performance deteriorates slightly compared to searching codes of all codebooks respectively, but the amount of computational complexity is reduced drastically. For this reason, this open-loop search is generally used.

Here, a typical algorithm in a conventional open-loop excitation vector search will be explained. Here, the excitation vector search procedure when one analysis section (frame) is composed of two subframes will be explained.

Figure 6:
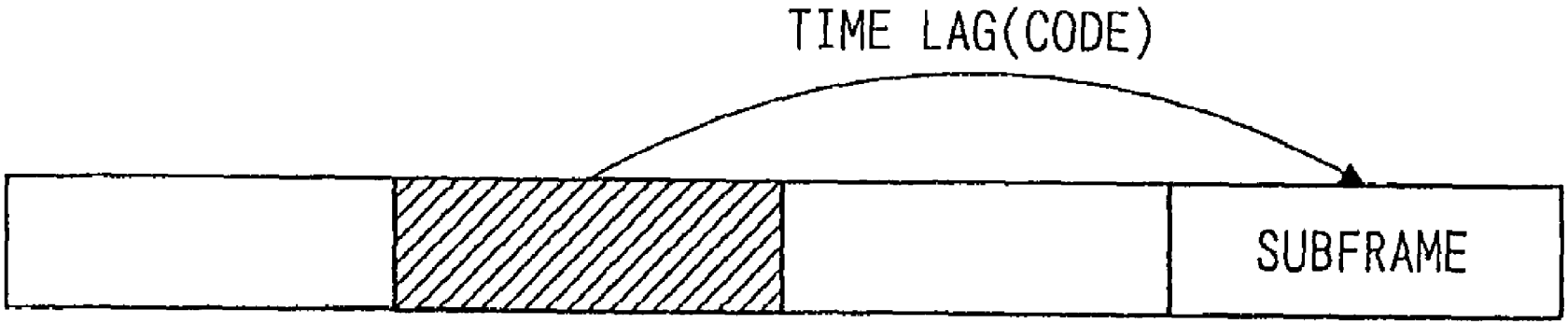
FIG. 6 is a drawing to explain an adaptive codebook search.

First, upon reception of an instruction from gain calculation section 108, excitation vector generator 105 extracts an excitation vector from adaptive codebook 103 and sends to perceptual weighted LPC synthesis filter 106. Gain calculation section 108 repeatedly compares the synthesized excitation vector and the input speech of the first subframe to find an optimal code. Here, the features of the adaptive codebook will be shown. The adaptive codebook consists of excitation vectors past used for speech synthesis. A code corresponds to a time lag as shown in FIG. 6.

Then, after a code of adaptive codebook 103 is determined, a search for the stochastic codebook is started. Excitation vector generator 105 extracts the excitation vector of the code obtained from the search of the adaptive codebook 103 and the excitation vector of the stochastic codebook 104 specified by gain calculation section 108 and sends these excitation vectors to perceptual weighted LPC synthesis filter 106. Then, gain calculation section 108 calculates coding distortion between the perceptual weighted synthesis speech and perceptual weighted input speech and determines an optimal (whose square error becomes a minimum) code of stochastic excitation vector 104. The procedure for an excitation vector code search in one analysis section (in the case of two subframes) is shown below.

1) Determines the code of the adaptive codebook of the first subframe.

2) Determines the code of the stochastic codebook of the first subframe.

3) Parameter coding section 109 codes gains, generates the excitation vector of the first subframe with decoded gains and updates adaptive codebook 103.

4) Determines the code of the adaptive codebook of the second subframe.

5) Determines the code of the stochastic codebook of the second subframe.

6) Parameter coding section 109 codes the gains, generates the excitation vector of the second subframe with decoded gain and updates adaptive codebook 103.

The algorithm above allows efficient coding of excitation vectors. However, an effort has been recently developed for decreasing the number of bits of excitation vectors aiming at a further reduction of the bit rate. What receives special attention is an algorithm of reducing the number of bits by taking advantage of the presence of a large correlation in a lag of the adaptive codebook and narrowing the search range of the second subframe to the range close to the lag of the first subframe (reducing the number of entries) while leaving the code of the first subframe as it is.

With this recently developed algorithm, local deterioration may be provoked, in the case speech signal in an analysis segment (frame) has a large change, or in the case the characteristics of the consecutive two frames are much different.

This embodiment provides a speech encoder that implements a search method of calculating correlation values by performing a pitch analysis for two subframes respectively, before starting coding and determining the range of searching a lag between two subframes based on the correlation values obtained.

More specifically, the speech encoder of this embodiment is a CELP type encoder that breaks down one frame into a plurality of subframes and codes respective frames, characterized by comprising a pitch analysis section that performs a pitch analysis of a plurality of subframes in the processing frame respectively, and calculates correlation values before searching the first subframe in the adaptive codebook and a search range setting section that while the pitch analysis section calculates correlation values of a plurality of subframes in the processing frame respectively, finds the value most likely to be the pitch cycle (typical pitch) on each subframe from the size of the correlation values and determines the search range of a lag between a plurality of subframes based on the correlation values obtained by the pitch analysis section and the typical pitch. Then, the search range setting section of this speech encoder determines a provisional pitch that becomes the center of the search range using the typical pitch of a plurality of subframes obtained by the pitch analysis section and the correlation value and the search range setting section sets the lag search range in a specified range around the determined provisional pitch and sets the search range before and after the provisional pitch when the lag search range is set. Moreover, in this case, the search range setting section reduces the number of candidates for the short lag section (pitch period), widely sets the range of a long lag and searches the lag in the range set by the search range setting section during the search in the adaptive codebook.

The speech encoder of this embodiment will be explained in detail below using the attached drawings. Here, suppose one frame is divided into two subframes. The same procedure can also be used for coding in the case of 3 subframes or more.

In a pitch search according to a so-called delta lag coding system, this speech coder finds pitches of all subframes in the processing frame, determines the level of a correlation between pitches and determines the search range according to the correlation result.

Figure 7:
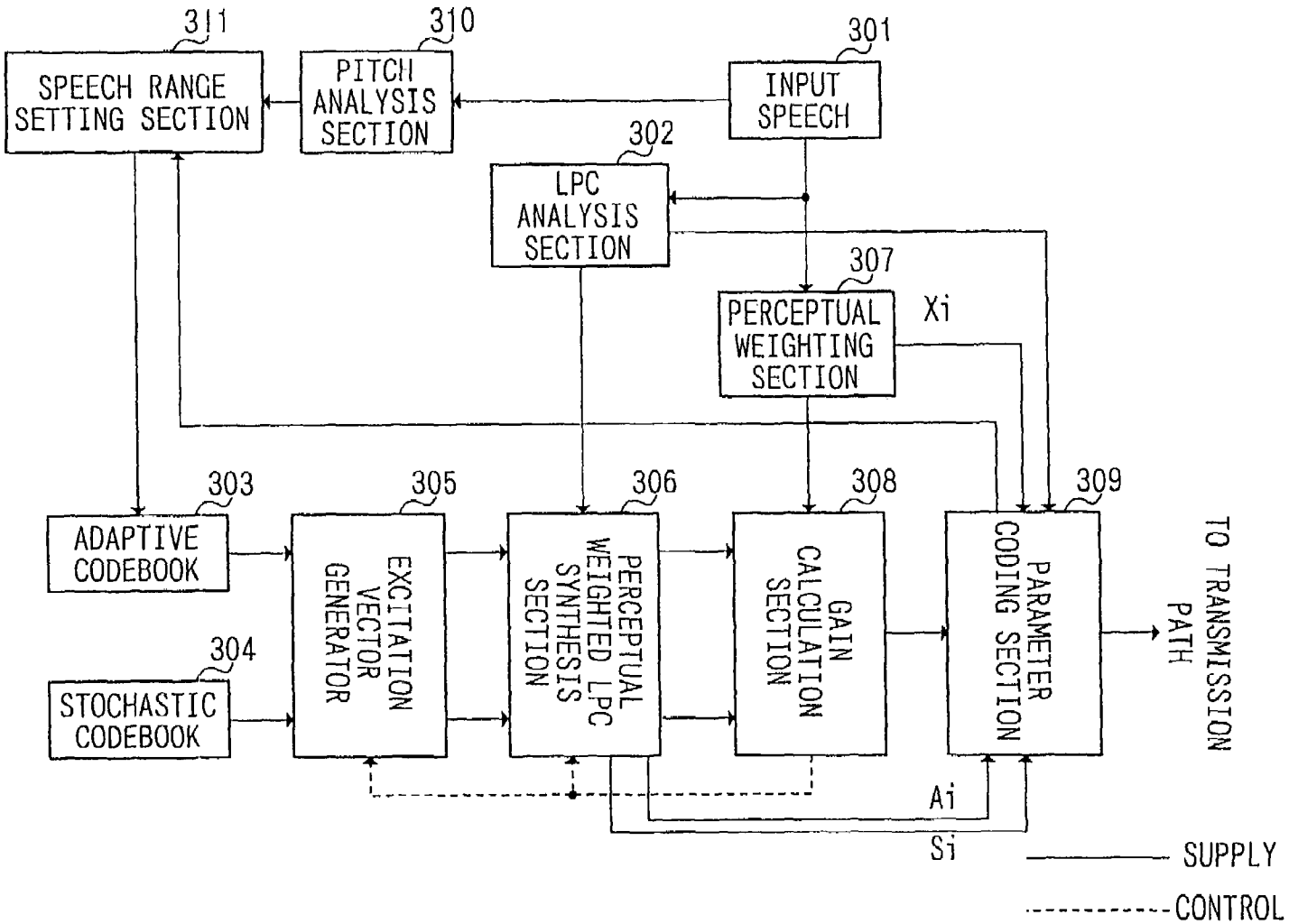
FIG. 7 is a block diagram showing a configuration of a speech encoder according to Embodiment 2 of the present invention.

FIG. 7 is a block diagram showing a configuration of the speech encoder according to Embodiment 2 of the present invention. First, LPC analysis section 302 performs an autocorrelation analysis and LPC analysis on speech data input (input speech) 301 entered and obtains LPC coefficients. Moreover, LPC analysis section 302 performs coding on the LPC coefficients obtained and obtains an LPC code. Furthermore, LPC analysis section 302 decodes the LPC code obtained and obtains decoded LPC coefficients.

Then, pitch analysis section 310 performs pitch analysis for consecutive 2 subframe respectively, and obtains a pitch candidate and a parameter for each subframe. The pitch analysis algorithm for one subframe is shown below. Two correlation coefficients are obtained from expression 7 below. At this time, $C_{pp}$ is obtained about $P_{min}$ first and remaining $P_{min+1}$ and $P_{min+2}$ can be calculated efficiently by subtraction and addition of the values at the frame end.

Expression 7

$$Vp = \sum_{i=0}^{L} Xi \times Xi - P \qquad (P = P\min \sim P\max)$$

$$Cpp = \sum_{i=0}^{L} Xi - P \times Xi - P \qquad (P = P\min \sim P\max)$$

where:

$XX_i$, $X_{i-P}$: Input speech $V_p$: Autocorrelation function $C_{pp}$: Power component i: Input speech sample number L: Subframe length P: Pitch $P_{min}$, $P_{max}$: Minimum value and maximum value for pitch search Then, the autocorrelation function and power component calculated from expression 7 above are stored in memory and the following procedure is used to calculate typical pitch $P_1$. This is the processing of calculating pitch P that corresponds to a maximum of $V_p \times V_p / C_{pp}$ while $V_p$ is positive. However, since a division calculation generally requires a greater amount of computational complexities, both the numerator and denominator are stored to convert the division to a multiplication to reduce the computational complexities.

Here, a pitch is found in such a way that the sum of square of the input speech and the square of the difference between the input speech and the adaptive excitation vector ahead of the input speech by the pitch becomes a minimum. This processing is equivalent to the processing of finding pitch P corresponding to a maximum of $V_p \times V_p / C_{pp}$. Specific processing is as follows:

1) Initialization ($P=P_{min}$, $VV=C=0$, $P_1=P_{min}$).

2) If ($V_p \times V_p \times C < VV \times C_{pp}$) or ($V_p<0$), then go to 4). Otherwise, go to 3).

3) Supposing $VV=V_p \times V_p$, $C=C_{pp}$, $P_1=P$, go to 4).

4) Suppose $P=P+1$. At this time, if $P>P_{max}$, the process ends. Otherwise, go to 2).

Perform the operation above for each of 2 subframes to calculate typical pitches $P_1$ and $P_2$, autocorrelation coefficients $V_{1p}$ and $V_{2p}$, power components $C_{1pp}$ and $C_{2pp}$ ($P_{min}<p<P_{max}$).

Then, search range setting section 311 sets the search range of the lag in the adaptive codebook. First, a provisional pitch, which is the center of the search range is calculated. The provisional pitch is calculated using the typical pitch and parameter obtained by pitch analysis section 310.

Provisional pitches $Q_1$ and $Q_2$ are calculated using the following procedure. In the following explanation, constant Th (more specifically, a value 6 or so is appropriate) as the lag range. Moreover, the correlation value obtained from expression 7 above is used.

While $P_1$ is fixed, provisional pitch ($Q_2$) with the maximum correlation is found near $P_1$ (±Th) first.

1) Initialization ($p=P_1-Th$, $C_{max}=0$ $Q_1=P_1$, $Q_2=P_1$).

2) If ($V_{1p1} \times V_{1p1}/C_{1p1p1}+V_{2p} \times V_{2p}/C_{2pp}<C_{max}$) or ($V_{2p}<0$) then go to 4). Otherwise, go to 3).

3) Supposing $C_{max}=V_{1p1} \times V_{1p1}/C_{1p1p1}+V_{2p} \times V_{2p}/C_{2pp}$, $Q_2=p$, go to 4).

4) Supposing $p=p+1$, go to 2). However, at this time, if $p>P_1+Th$, go to 5).

In this way, processing in 2) to 4) is performed from $P_1-Th$ to $P_1+Th$, the one with the maximum correlation, $C_{max}$ and provisional pitch $Q_2$ are found.

Then, while $P_2$ is fixed, provisional pitch ($Q_1$) near $P_2$ (±Th) with a maximum correlation is found. In this case, $C_{max}$ will not be initialized. By calculating $Q_1$ whose correlation becomes a maximum including $C_{max}$ when $Q_2$ is found, it is possible to find $Q_1$ and $Q_2$ with the maximum correlation between the first and second subframes.

5) Initialization ($p=P_2-Th$).

6) If ($V_{1p} \times V_{1p}/C_{1pp}+V_{2p2} \times V_{2p2}/C_{2p2p2}<C_{max}$) or ($V_{1p}<0$), go to 8). Otherwise, go to 7).

7) Supposing $C_{max}=V_{1p} \times V_{1p}/C_{1pp}+V_{2p2} \times V_{2p2}/C_{2p2p2}$, $Q_1=p$, $Q_2=P_2$, go to 8).

8) Supposing $p=p+1$, go to 6). However, at this time if $p>P_2+Th$, go to 9).

9) End.

In this way, perform processing in 6) to 8) from $P_2-Th$ to $P_2+Th$, the one with the maximum correlation, $C_{max}$ and provisional pitches $Q_1$ and $Q_2$ are found. $Q_1$ and $Q_2$ at this time are provisional pitches of the first and second subframes, respectively.

From the algorithm above, it is possible to select two provisional pitches with a relatively small difference in size (the maximum difference is Th) while evaluating the correlation between two subframes simultaneously. Using these provisional pitches prevents the coding performance from drastically deteriorating even if a small search range is set during a search of the second subframe in the adaptive codebook. For example, when sound quality changes suddenly from the second subframe, if there is a strong correlation of the second subframe, using $Q_1$ that reflects the correlation of the second subframe can avoid the deterioration of the second subframe.

Furthermore, search range setting section 311 sets the search range ($L_ST$ to $L_EN$) of the adaptive codebook using provisional pitch $Q_1$ obtained as expression 8 below:

First Subframe $$L_ST=Q1\text{-}5 \text{ (when } L_ST<L\min,\ L_ST=L\min)$$

$$L_EN=L_ST+20 \text{ (when } L_ST>L\max,\ L_ST=L\max)$$

Second Subframe $$L_ST=T1\text{-}10 \text{ (when } L_ST<L\min,\ L_ST=L\min)$$

$$L_EN=L_ST+21 \text{ (when } L_ST>L\max,\ L_ST=L\max) \qquad \text{Expression 8}$$

where:

$L_ST$: Minimum of search range $L_EN$: Maximum of search range $L_{min}$: Minimum value of lag (e.g., 20)

$L_{max}$: Maximum value of lag (e.g., 143)

$T_1$: Adaptive codebook lag of first frame

In the above setting, it is not necessary to narrow the search range for the first subframe. However, the present inventor, et al. have confirmed through experiments that the performance is improved by setting the vicinity of a value based on the pitch of the input speech as the search range and this embodiment uses an algorithm of searching by narrowing the search range to 26 samples.

On the other hand, for the second subframe, the search range is set to the vicinity of lag $T_1$ obtained by the first subframe. Therefore, it is possible to perform 5-bit coding on the adaptive codebook lag of the second subframe with a total of 32 entries. Furthermore, the present inventor, et al. have also confirmed this time through experiments that the performance is improved by setting fewer candidates with a short lag and more candidates with a long lag. However, as is apparent from the explanations heretofore, this embodiment does not use provisional pitch $Q_2$.

Here, the effects of this embodiment will be explained. In the vicinity of the provisional pitch of the first subframe obtained by search range setting section 311, the provisional pitch of the second subframe also exists (because it is restricted with constant Th) Furthermore, since a search has been performed with the search range narrowed in the first subframe, the lag resultant from the search is not separated from the provisional pitch of the first subframe.

Therefore, when the second subframe is searched, the search can be performed in the range close to the provisional pitch of the second subframe, and therefore it is possible to search lags appropriate for both the first and second frames.

Suppose a example where the first subframe is a silent-speech and the second subframe is not a silent-speech.

According to the conventional method, sound quality will deteriorate drastically if the second subframe pitch is no longer included in the search section by narrowing the search range. According to the method of this embodiment, a strong correlation of typical pitch $P_2$ is reflected in the analysis of the provisional pitch of the pitch analysis section. Therefore, the provisional pitch of the first subframe has a value close to $P_2$. This makes it possible to determine the range close to the part at which the speech starts as the provisional pitch in the case of a search by a delta lag. That is, in the case of an adaptive codebook search of the second subframe, a value close to $P_2$ can be searched, and therefore it is possible to perform an adaptive codebook search of the second subframe by a delta lag even if speech starts at some midpoint in the second subframe.

Then, excitation vector generator 305 extracts the excitation vector sample (adaptive code vector or adaptive excitation vector) stored in adaptive codebook 303 and the excitation vector sample (stochastic code vector or stochastic excitation vector) stored in stochastic codebook 304 and sends these excitation vector samples to perceptual weighted LPC synthesis filter 306. Furthermore, perceptual weighted LPC synthesis filter 306 performs filtering on the two excitation vectors obtained by excitation vector generator 305 using the decoded LPC coefficients obtained by LPC analysis section 302.

Furthermore, gain calculation section 308 analyzes the relationship between the two synthesized speeches obtained by perceptual weighted LPC synthesis filter 306 and the input speech and finds respective optimal values (optimal gains) of the two synthesized speeches. Gain calculation section 308 adds up the respective synthesized speeches with power adjusted with the optimal gain and obtains an overall synthesized speech. Then, gain calculation section 308 calculates coding distortion between the overall synthesized speech and the input speech. Furthermore, gain calculation section 308 calculates coding distortion between many synthesized speeches obtained by making function excitation vector generator 305 and perceptual weighted LPC synthesis filter 306 on all excitation vector samples in adaptive codebook 303 and stochastic codebook 304 and the input speech, and finds the indexes of the excitation vector samples corresponding to the minimum of the resultant coding distortion.

Then, gain calculation section 308 sends the indexes of the excitation vector samples obtained and the two excitation vectors corresponding to the indexes and the input speech to parameter coding section 309. Parameter coding section 309 obtains a gain code by performing gain coding and sends the gain code together with the LPC code and indexes of the excitation vector samples to the transmission path.

Furthermore, parameter coding section 309 creates an actual excitation vector signal from the gain code and the two excitation vectors corresponding to the indexes of the excitation vector samples and stores the actual excitation vector signal in adaptive codebook 303 and at the same time discards the old excitation vector sample.

By the way, perceptual weighted LPC synthesis filter 306 uses a perceptual weighting filter using an LPC coefficients, high frequency enhancement filter and long-term prediction coefficient (obtained by performing a long-term predictive analysis of the input speech).

Gain calculation section 308 above makes a comparison with the input speech about all possible excitation vectors in adaptive codebook 303 and all possible stochastic codebook 304 obtained from excitation vector generator 305, but two excitation vectors (adaptive codebook 303 and stochastic codebook 304) are searched in an openloop as described above in order to reduce the amount of computational complexity.

Thus, the pitch search method in this embodiment performs pitch analyses of a plurality of subframes in the processing frame respectively before performing an adaptive codebook search of the first subframe, then calculates a correlation value and thereby can control correlation values of all subframes in the frame simultaneously.

Then, the pitch search method in this embodiment calculates a correlation value of each subframe, finds a value most likely to be a pitch period (called a "typical pitch") in each subframe according to the size of the correlation value and sets the lag search range of a plurality of subframes based on the correlation value obtained from the pitch analysis and typical pitch. In the setting of this search range, the pitch search method in this embodiment obtains an appropriate provisional pitch (called a "provisional pitch") with a small difference, which will be the center of the search range, using the typical pitches of a plurality of subframes obtained from the pitch analyses and the correlation values.

Furthermore, the pitch search method in this embodiment confines the lag search section to a specified range before and after the provisional pitch obtained in the setting of the search range above, allowing an efficient search of the adaptive codebook. In that case, the pitch search method in this embodiment sets fewer candidates with a short lag part and a wider range with a long lag, making it possible to set an appropriate search range where satisfactory performance can be obtained. Furthermore, the pitch search method in this embodiment performs a lag search within the range set by the setting of the search range above during an adaptive codebook search, allowing coding capable of obtaining satisfactory decoded sound.

Thus, according to this embodiment, the provisional pitch of the second subframe also exists near the provisional pitch of the first subframe obtained by search range setting section 311 and the search range is narrowed in the first subframe, and therefore the lag resulting from the search does not get away from the provisional pitch. Therefore, during a search of the second subframe, it is possible to search around the provisional pitch of the second subframe allowing an appropriate lag search in the first and second subframes even in a non-stationary frame in the case where a speech starts from the last half of a frame, and thereby attain a special effect that has not been attained with conventional arts.

EMBODIMENT 3

An initial CELP system uses a stochastic codebook with entries of a plurality of types of random sequence as stochastic excitation vectors, that is, a stochastic codebook with a plurality of types of random sequence directly stored in memory. On the other hand, many low bit-rate CELP encoder/decoder have been developed in recent years, which include an algebraic codebook to generate stochastic excitation vectors containing a small number of non-zero elements whose amplitude is +1 or −1 (the amplitude of elements other than the non-zero element is zero) in the stochastic codebook section.

By the way, the algebraic codebook is disclosed in the "Fast CELP Coding based on Algebraic codes", J. Adoul et al, Proc. IEEE Int. Conf. Acoustics, Speech, Signal Processing, 1987, pp. 1957-1960 or "Comparison of Some Algebraic Structure for CELP Coding of Speech", J. Adoul et al, Proc. IEEE Int. Conf. Acoustics, Speech, Signal Processing, 1987, pp. 1953-1956, etc.

The algebraic codebook disclosed in the above papers is a codebook having excellent features such as (1) ability to generate synthesized speech of high quality when applied to a CELP system with a bit rate of approximately 8 kb/s, (2) ability to search a stochastic with a small amount of computational complexity, and (3) elimination of the necessity of data ROM capacity to directly store stochastic excitation vectors.

Then, CS-ACELP (bit rate: 8 kb/s) and ACELP (bit rate: 5.3 kb/s) characterized by using an algebraic codebook as a stochastic codebook are recommended as G.729 and g723.1, respectively from the ITU-T in 1996. By the way, detailed technologies of CS-ACELP are disclosed in "Design and Description of CS-ACELP: A Toll Quality 8 kb/s Speech Coder", Redwan Salami et al, IEEE trans. SPEECH AND AUDIO PROCESSING, vol. 6, no. 2, March 1998, etc.

The algebraic codebook is a codebook with the excellent features as described above. However, when the algebraic codebook is applied to the stochastic codebook of a CEL-Pencoder/decoder, the target vector for stochastic codebook search is always encoded/decoded (vector quantization) with stochastic excitation vectors including a small number of non-zero elements, and thus the algebraic codebook has a problem that it is impossible to a express a target vector for stochastic codebook search in high fidelity. This problem becomes especially conspicuous when the processing frame corresponds to an unvoiced consonant segment or background noise segment.

This is because the target vector for stochastic codebook search often takes a complicated shape in an unvoiced consonant segment or background noise segment. Furthermore, in the case where the algebraic codebook is applied to a CELP encoder/decoder whose bit rate is much lower than the order of 8 kb/s, the number of non-zero elements in the stochastic excitation vector is reduced, and therefore the above problem can become a bottleneck even in a stationary voiced segment where the target vector for stochastic codebook search is likely to be a pulse-like shape.

As one of methods for solving the above problem of the algebraic codebook, a method using a dispersed-pulse codebook is disclosed, which uses a vector obtained by convoluting a vector containing a small number of non-zero elements (elements other than non-zero elements have a zero value) output from the algebraic codebook and a fixed waveform called a "dispersion pattern" as the excitation vector of a synthesis filter. The dispersed-pulse codebook is disclosed in the Unexamined Japanese Patent Publication No.HEI 10-232696, "ACELP Coding with Dispersed-Pulse Codebook" (by Yasunaga, et al., Collection of Preliminary Manuscripts of National Conference of Institute of Electronics, Information and Communication Engineers in Springtime 1997, D-14-11, p. 253, 1997-03) and "A Low Bit Rate Speech Coding with Multi Dispersed Pulse based Codebook" (by Yasunaga, et al., Collected Papers of Research Lecture Conference of Acoustical Society of Japan in Autumn 1998, pp. 281-282, 1998-10), etc.

Next, an outline of the dispersed-pulse codebook disclosed in the above papers will be explained using FIG. 8 and FIG. 9. FIG. 9 shows a further detailed example of the dispersed-pulse codebook in FIG. 8.

Figure 8:
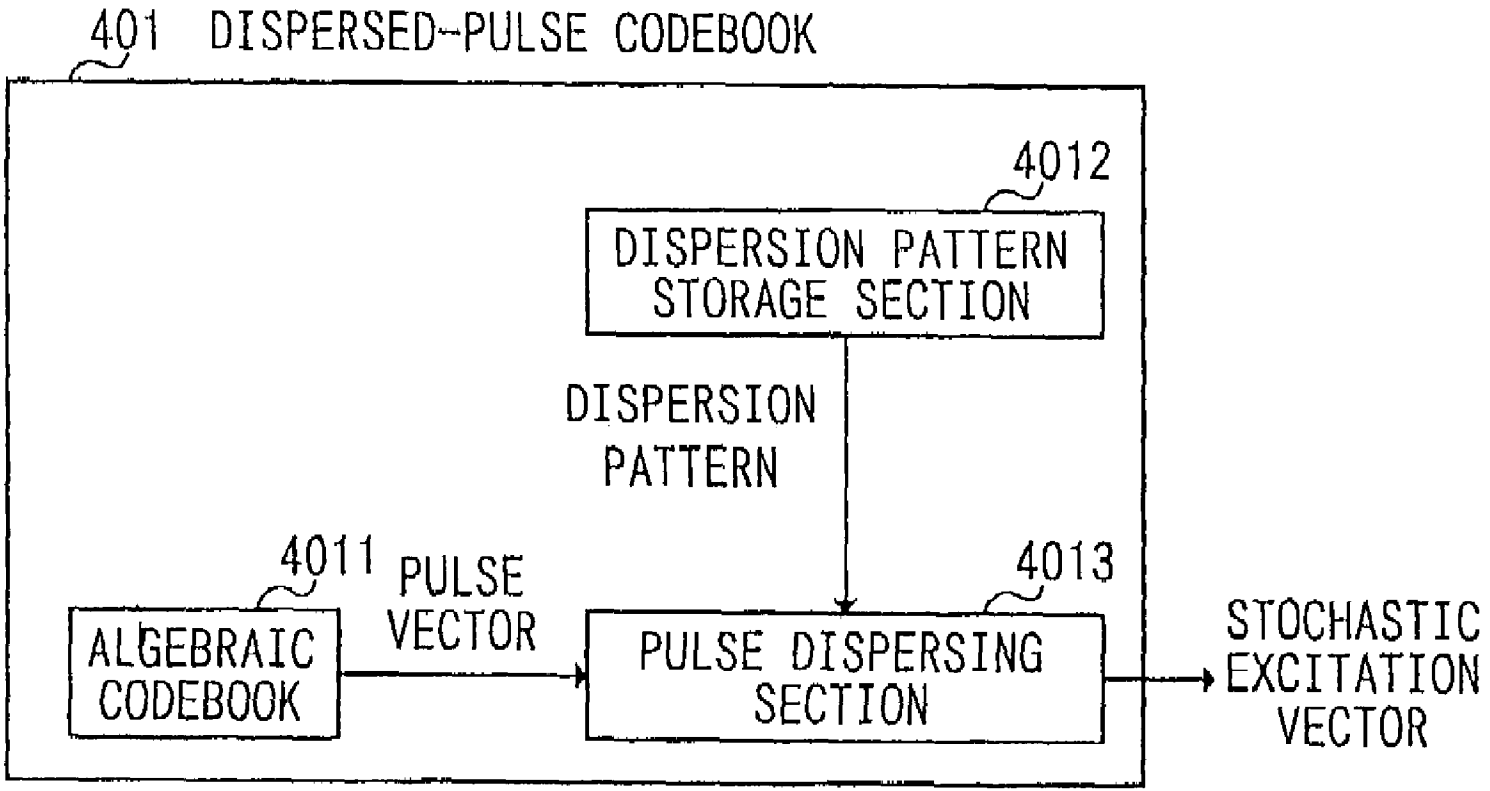
FIG. 8 is a block diagram to explain a dispersed-pulse codebook.
Figure 9:
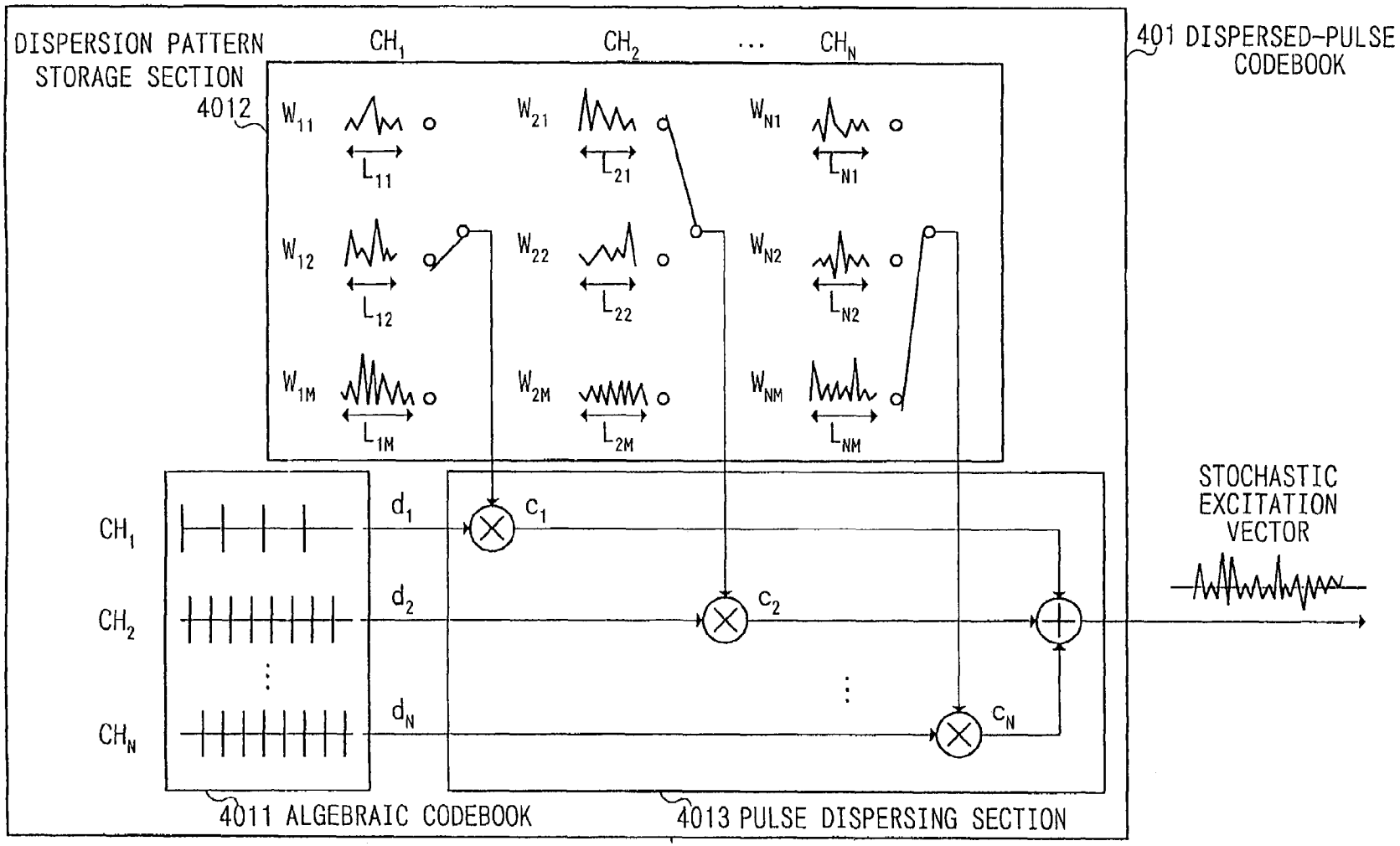
FIG. 9 is a block diagram showing an example of a detailed configuration of the dispersed-pulse codebook.

In the dispersed-pulse codebook in FIG. 8 and FIG. 9, algebraic codebook 4011 is a codebook for generating a pulse vector made up of a small number of non-zero elements (amplitude is +1 or −1). The CELP encoder/decoder described in the above papers uses a pulse vector (made up of a small number of non-zero elements), which is the output of algebraic codebook 4011, as the stochastic excitation vector.

Dispersion pattern storage section 4012 stores at least one type of fixed waveform called a "dispersion pattern" for every channel. There can be two cases of dispersion patterns stored for every channel: one case where dispersion patterns differing from one channel to another are stored and the other case where a dispersion pattern of a same (common) shape for all channels is stored. The case where a common dispersion pattern is stored for all channels corresponds to simplification of the case where dispersion pattern differing from one channel to another are stored, and therefore the case where dispersion patterns differing from one channel to another are stored will be explained in the following explanations of the present description.

Instead of directly outputting the output vector from algebraic codebook 4011 as a stochastic excitation vector, dispersed-pulse codebook 401 convolutes the vector output from algebraic codebook 4011 and dispersion patterns read from dispersion pattern storage section 4012 for every channel in pulse dispersing section 4013, adds up vectors resulting from the convolution calculations and uses the resulting vector as the stochastic excitation vector.

The CELP encoder/decoder disclosed in the above papers is characterized by using a dispersed-pulse codebook in a same configuration for the encoder and decoder (the number of channels in the algebraic codebook, the number of types and shape of dispersion patterns registered in the dispersion pattern storage section are common between the encoder and decoder). Moreover, the CELP encoder/decoder disclosed in the above papers aims at improving the quality of synthesized speech by efficiently setting the shapes and the number of types of dispersion patterns registered in dispersion pattern storage section 4012, and the method of selecting in the case where a plurality of types of dispersion patterns are registered.

By the way, the explanation of the dispersed-pulse codebook here describes the case where an algebraic codebook that confines the amplitude of non-zero elements to +1 or −1 is used as the codebook for generating a pulse vector made up of a small number of non-zero elements. However, as the codebook for generating the relevant pulse vectors, it is also possible to use a multi-pulse codebook that does not confine the amplitude of non-zero elements or a regular pulse codebook, and in such cases, it is also possible to improve the quality of the synthesized speech by using a pulse vector convoluted with a dispersion pattern as the stochastic excitation vector.

It has been disclosed so far that it is possible to effectively improve the quality of a synthesized speech by registering dispersion patterns obtained by statistically training of shapes based on a huge number of target vectors for stochastic codebook search, dispersion patterns of random-like shapes to efficiently express the unvoiced consonant segments and noise-like segments, dispersion patterns of pulse-like shapes to efficiently express the stationary voiced segment, dispersion patterns of shapes such that the energy of pulse vectors output from the algebraic codebook (energy is concentrated on the positions of non-zero elements) is spread around, dispersion patterns selected from among several arbitrarily prepared dispersion pattern candidates so that a synthesized speech of high quality can be output by encoding and decoding a speech signal and repeating subjective (listening) evaluation tests of the synthesized speech or dispersion patterns created based on phonological knowledge, etc. at least one type per non-zero element (channel) in the excitation vector output from the algebraic codebook, convoluting the registered dispersion patterns and vectors generated by the algebraic codebook (made up of a small number of non-zero elements) for every channel, adding up the convolution results of respective channels and using the addition result as the stochastic excitation vector.

Moreover, especially when dispersion pattern storage section 4012 registers dispersion patterns of a plurality of types (two or more types) per channel, methods disclosed as the methods for selecting a plurality of these dispersion patterns include: a method of actually performing encoding and decoding on all combinations of the registered dispersion patterns and "closed-loop search" a dispersion pattern corresponding to a minimum of the resulting coding distortion and a method for "open-loop search" dispersion patterns using speech-like information which is already made clear when a stochastic codebook search is performed (the speech-like information here refers to, for example, voicing strength information judged using dynamic variation information of gain codes or comparison result between gain values and a preset threshold value or voicing strength information judged using dynamic variation of linear predictive codes).

Figure 10:
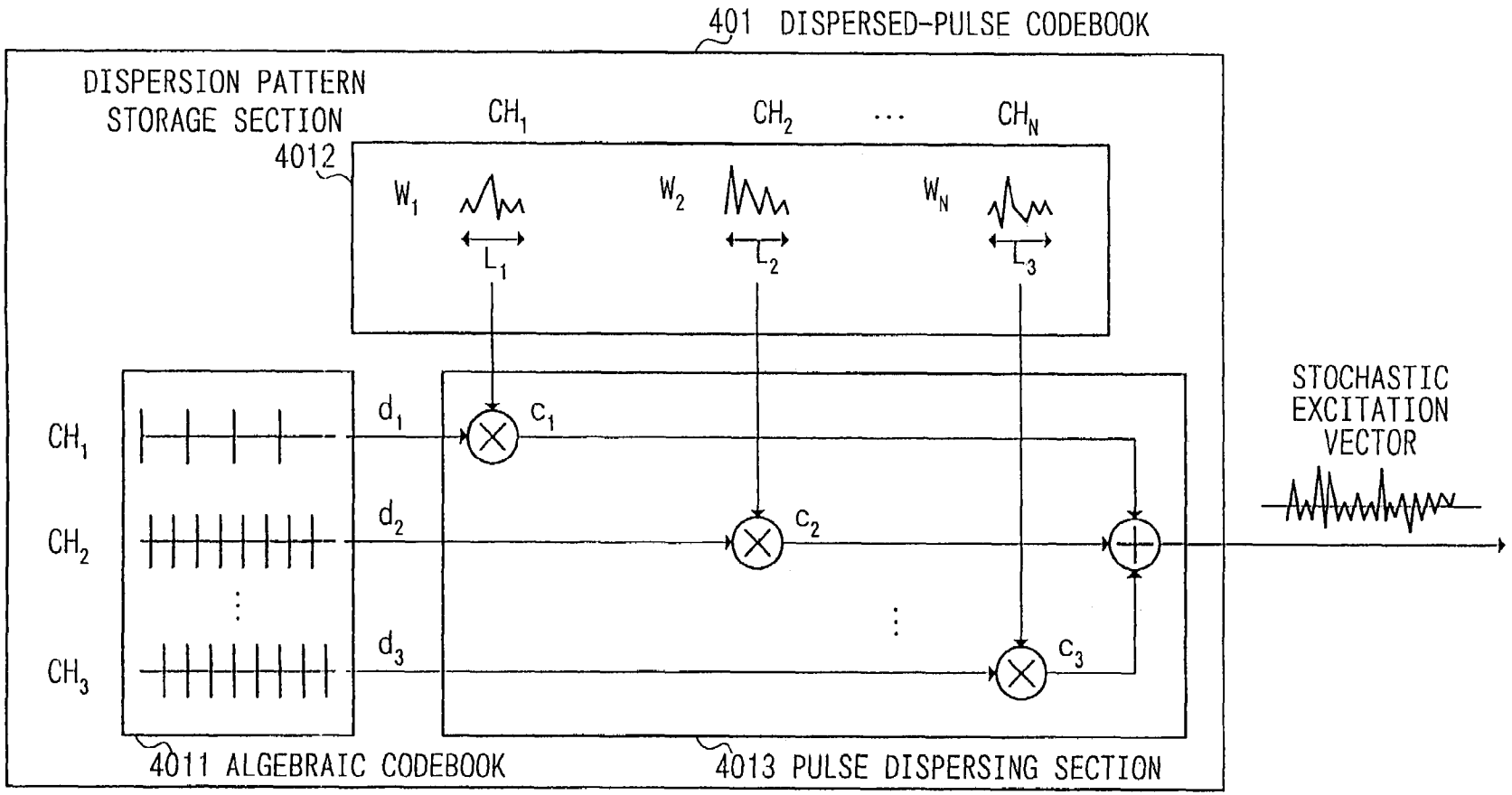
FIG. 10 is a block diagram showing an example of a detailed configuration of the dispersed-pulse codebook.

By the way, for simplicity of explanations, the following explanations will be confined to a dispersed-pulse codebook in FIG. 10 characterized in that dispersion pattern storage section 4012 in the dispersed-pulse codebook in FIG. 9 registers dispersion pattern of only one type per channel.

Here, the following explanation will describe stochastic codebook search processing in the case where a dispersed-pulse codebook is applied to a CELP encoder in contrast to stochastic codebook search processing in the case where an algebraic codebook is applied to a CELPencoder. First, the codebook search processing when an algebraic codebook is used for the stochastic codebook section will be explained.

Suppose the number of non-zero elements in a vector output by the algebraic codebook is N (the number of channels of the algebraic codebook is N), a vector including only one non-zero element whose amplitude output per channel is +1 or −1 (the amplitude of elements other than non-zero elements is zero) is di (i: channel number: $0 \leqq i \leqq N-1$) and the subframe length is L. Stochastic excitation vector ck with entry number k output by the algebraic codebook is expressed in expression 9 below:

$$Ck = \sum_{i=0}^{N-1} di \qquad \text{Expression 9}$$

where:

Ck: Stochastic excitation vector with entry number K according to algebraic codebook di: Non-zero element vector (di=±δ(n−pi), where pi: position of non-zero element)

N: The number of channels of algebraic codebook (=The number of non-zero elements in stochastic excitation vector)

Then, by substituting expression 9 into expression 10, expression 11 below is obtained:

$$Dk = \frac{(v^t Hck)^2}{\|Hc_K\|^2} \qquad \text{Expression 10}$$

where:

$v^t$: Transposition vector of v (target vector for stochastic codebook search $H^t$: Transposition matrix of H (impulse response matrix of the synthesis filter)

ck: Stochastic excitation vector of entry number k $$Dk = \frac{\left(v^t H\left(\sum_{i=0}^{N-1} di\right)\right)^2}{\left\|H\left(\sum_{i=0}^{N-1} di\right)\right\|} \qquad \text{Expression 11}$$

where:

v: target vector for stochastic codebook search

H: Impulse response convolution matrix of the synthesis filter di: Non-zero element vector (di=±δ(n−pi), where pi: position of non-zero element)

N: The number of channels of algebraic codebook (=The number of non-zero elements in stochastic excitation vector)

$x^t = v^t H$ $M = H^t H$

The processing to identify entry number k that maximizes expression 12 below obtained by arranging this expression 10 becomes stochastic codebook search processing.

$$Dk = \frac{\left(\left(\sum_{i=0}^{N-1} x^t d_i\right)\right)^2}{\sum_{i=0}^{N-1}\sum_{j=0}^{N-1} d_i^t M d_j} \qquad \text{Expression 12}$$

where, $x^t = v^t H$, $M = H^t H$ (v is a target vector for stochastic codebook search) in expression 12. Here, when the value of expression 12 about each entry number k is calculated, $x^t = v^t H$ and $M = H^t H$ are calculated in the pre-processing stage and the calculation result is developed (stored) in memory. It is disclosed in the above papers, etc. and generally known that introducing this pre-processing makes it possible to drastically reduce the amount of computational complexity when expression 12 is calculated for every candidate entered as the stochastic excitation vector and as a result, suppress the total amount of computational complexity required for a stochastic codebook search to a small value.

Next, the stochastic codebook search processing when the dispersed-pulse codebook is used for the stochastic codebook will be explained.

Suppose the number of non-zero elements output from the algebraic codebook, which is a component of the dispersed-pulse codebook, is N(N: the number of channels of the algebraic codebook), a vector that includes only one non-zero element whose amplitude is +1 or −1 output for each channel (the amplitude of elements other than non-zero element is zero) is di (i: channel number: $0 \leqq i \leqq N-1$), the dispersion patterns for channel number i stored in the dispersion pattern storage section is wi and the subframe length is L. Then, stochastic excitation vector ck of entry number k output from the dispersed-pulse codebook is given by expression 13 below:

$$Ck = \sum_{i=0}^{N-1} Widi \qquad \text{Expression 13}$$

where:

Ck: Stochastic excitation vector of entry number k output from dispersed-pulse codebook Wi: dispersion pattern (wi) convolution matrix di: Non-zero element vector output by algebraic codebook section ($d_i = \pm\delta(n-p_i)$, where $p_i$: position of non-zero element)

N: The number of channels of algebraic codebook section

Therefore, in this case, expression 14 below is obtained by substituting expression 13 into expression 10.

$$Dk = \frac{\left(v^t H\left(\sum_{i=0}^{N-1} Widi\right)\right)^2}{\left\|H\left(\sum_{i=0}^{N-1} Widi\right)\right\|^2} \qquad \text{Expression 14}$$

where:

v: target vector for stochastic codebook search

H: Impulse response convolution matrix of synthesis filter

Wi: Dispersion pattern (wi) convolution matrix di: Non-zero element vector output by typical codebook section ($di = \pm\delta(n-p_i)$, where $p_i$: position of non-zero element)

N: The number of channels of algebraic codebook (=the number of non-zero elements in stochastic excitation vector)

$Hi = HWi$ $x_i^t = v^t Hi$ $R = HiHj$

The processing of identifying entry number k of the stochastic excitation vector that maximizes expression 15 below obtained by arranging this expression 14 is the stochastic codebook search processing when the dispersed-pulse codebook is used.

$$Dk = \frac{\left(\left(\sum_{i=0}^{N-1} x_i^t d_i\right)\right)^2}{\sum_{i=0}^{N-1}\sum_{j=0}^{N-1} d_i^t R d_j} \qquad \text{Expression 15}$$

where, in expression 15, $x^t = v^t Hi$ (where Hi=HWi: Wi is the dispersion pattern convolution matrix). When a value of expression 15 is calculated for each entry number k, it is possible to calculate Hi=HWi, $x^t = v^t Hi$ and $R = Hi^t Hj$ as the pre-processing and record this in memory. Then, the amount of computational complexity to calculate expression 15 for each candidate entered as a stochastic excitation vector becomes equal to the amount of computational complexity to calculate expression 12 when the algebraic codebook is used (it is obvious that expression 12 and expression 15 have the same form) and it is possible to perform a stochastic codebook search with a small amount of computational complexity even when the dispersed-pulse codebook is used.

The above technology shows the effects of using the dispersed-pulse codebook for the stochastic codebook section of the CELP encoder/decoder and shows that when used for the stochastic codebook section, the dispersed-pulse codebook makes it possible to perform a stochastic codebook search with the same method as that when the algebraic codebook is used for the stochastic codebook section. The difference between the amount of computational complexity required for a stochastic codebook search when the algebraic codebook is used for the stochastic codebook section and the amount of computational complexity required for a stochastic codebook search when the dispersed-pulse codebook is used for the stochastic codebook section corresponds to the difference between the amounts of computational complexity required for the pre-processing stage of expression 12 and expression 15, that is, the difference between the amounts of computational complexity required for pre-processing ($x^t = v^t Hi$, $M = H^t H$) and pre-processing (Hi=HWi, $x^t = v^t Hi$, $R = Hi^t Hj$).

In general, with the CELPencoder/decoder, as the bit rate decreases, the number of bits assignable to the stochastic codebook section also tends to be decreased. This tendency leads to a decrease in the number of non-zero elements when a stochastic excitation vector is formed in the case where the algebraic codebook and dispersed-pulse codebook are used for the stochastic codebook section. Therefore, as the bit rate of the CELP encoder/decoder decreases, the difference in the amount of computational complexity when the algebraic codebook is used and when the dispersed-pulse codebook is used decreases. However, when the bit rate is relatively high or when the amount of computational complexity needs to be reduced even if the bit rate is low, the increase in the amount of computational complexity in the pre-processing stage resulting from using the dispersed-pulse codebook is not negligible.

This embodiment explains the case where in a CELP-based speech encoder and speech decoder and speech encoding/decoding system using a dispersed-pulse codebook for the stochastic codebook section, the decoding side obtains synthesized speech of high quality while suppressing to a low level the increase in the amount of computational complexity of the pre-processing section in the stochastic codebook search processing, which increases compared with the case where the algebraic codebook is used for the stochastic codebook section.

More specifically, the technology according to this embodiment is intended to solve the problem above that may occur when the dispersed-pulse codebook is used for the stochastic codebook section of the CELPencoder/decoder, and is characterized by using a dispersion pattern, which differs between the encoder and decoder. That is, this embodiment registers the above-described dispersion pattern in the dispersion pattern storage section on the speech decoder side and generates synthesized speech of higher quality using the dispersion pattern than using the algebraic codebook.

On the other hand, the speech encoder registers a dispersion pattern, which is the simplified dispersion pattern to be registered in the dispersion pattern storage section of the decoder (e.g., dispersion pattern selected at certain intervals or dispersion pattern truncated at a certain length) and performs a stochastic codebook search using the simplified dispersion pattern.

When the dispersed-pulse codebook is used for the stochastic codebook section, this allows the coding side to suppress to a small level the amount of computational complexity at the time of a stochastic codebook search in the pre-processing stage, which increases compared to the case where the algebraic codebook is used for the stochastic codebook section and allows the decoding side to obtain a synthesized speech of high quality.

Using different dispersion patterns for the encoder and decoder means acquiring an dispersion pattern for the encoder by modifying the prepared spreading vector (for the decoder) while reserving the characteristic.

Here, examples of the method for preparing a dispersion pattern for the decoder include the methods disclosed in the patent (Unexamined Japanese Patent Publication No. HEI 10-63300) applied for by the present inventor, et al., that is, a method for preparing a dispersion pattern by training of the statistic tendency of a huge number of target vectors for stochastic codebook search, a method for preparing a dispersion vector by repeating operations of encoding and decoding the actual target vector for stochastic codebook search and gradually modifying the decoded target vector in the direction in which the sum total of coding distortion generated is reduced, a method of designing based on phonological knowledge in order to achieve synthesized speech of high quality or a method of designing for the purpose of randomizing the high frequency phase component of the pulse excitation vector. All these contents are included here.

All these dispersion patterns acquired in this way are characterized in that the amplitude of a sample close to the start sample of the dispersion pattern (forward sample) is relatively larger than the amplitude of a backward sample. Above all, the amplitude of the start sample is often the maximum of all samples in the dispersion pattern (this is true in most cases).

The following are examples of the specific method for acquiring a dispersion pattern for the encoder by modifying the dispersion pattern for the decoder while reserving the characteristic:

1) Acquiring a dispersion pattern for the encoder by replacing the sample value of the dispersion pattern for the decoder with zero at appropriate intervals 2) Acquiring a dispersion pattern for the encoder by truncating the dispersion pattern for the decoder of a certain length at an appropriate length 3) Acquiring a dispersion pattern for the encoder by setting a threshold of amplitude beforehand and replacing a sample whose amplitude is smaller than a threshold set for the dispersion pattern for the decoder with zero 4) Acquiring a dispersion pattern for the coder by storing a sample value of the dispersion pattern for the decoder of a certain length at appropriate intervals including the start sample and replacing other sample values with zero Here, even in the case where a few samples from the beginning of the dispersion pattern is used as in the case of the method in 1) above, for example, it is possible to acquire a new dispersion pattern for the encoder while reserving an outline (gross characteristic) of the dispersion pattern.

Furthermore, even in the case where a sample value is replaced with zero at appropriate intervals as in the case of the method in 2) above, for example, it is possible to acquire a new dispersion pattern for the encoder while reserving an outline (gross-characteristic) of the original dispersion pattern. Especially, the method in 4) above includes a restriction that the amplitude of the start sample whose amplitude is often the largest should always be saved as is, and therefore it is possible to save an outline of the original spreading vector more reliably.

Furthermore, even in the case where a sample whose amplitude is equal to or larger than a specific threshold value is saved as is and a sample whose amplitude is smaller than the specific threshold value is replaced with zero as the method in the case of 3) above, it is possible to acquire a dispersion pattern for the encoder while reserving an outline (gross characteristic) of the dispersion pattern.

The speech encoder and speech decoder according to this embodiment will be explained in detail with reference to the attached drawings below. The CELP speech encoder (FIG. 11) and the CELP speech decoder (FIG. 12) described in the attached drawings are characterized by using the above dispersed-pulse codebook for the stochastic codebook section of the conventional CELP speech encoder and the CELP speech decoder. Therefore, in the following explanations, it is possible to read the parts described "the stochastic codebook", "stochastic excitation vector" and "stochastic excitation vector gain" as "dispersed-pulse codebook", "dispersed-pulse excitation vector" and "dispersed-pulse excitation vector gain", respectively. The stochastic codebook in the CELP speech encoder and the CELP speech decoder has the function of storing a noise codebook or fixed waveforms of a plurality of types, and therefore is sometimes also called a "fixed codebook".

Figure 11:
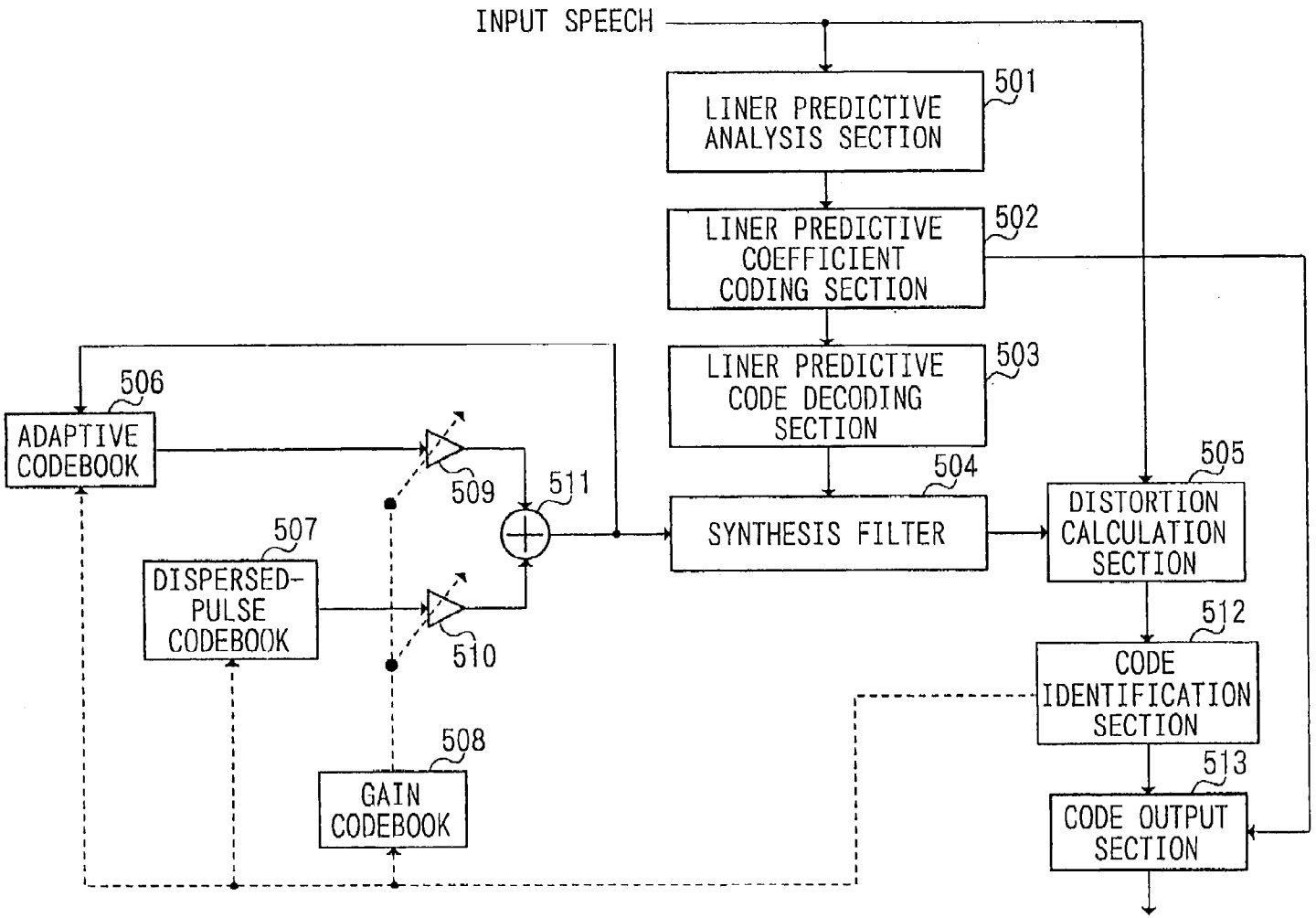
FIG. 11 is a block diagram showing a configuration of a speech encoder according to Embodiment 3 of the present invention.

In the CELP speech encoder in FIG. 11, linear predictive analysis section 501 performs a linear predictive analysis on the input speech and calculates a linear prediction coefficient first and then outputs the calculated linear prediction coefficient to linear prediction coefficient encoding section 502. Then, linear prediction coefficient encoding section 502 performs encoding (vector quantization) on the linear prediction coefficient and outputs the quantization index (hereinafter referred to as "linear predictive code") obtained by vector quantization to code output section 513 and linear predictive code decoding section 503.

Then, linear predictive code decoding section 503 performs decoding (inverse-quantization) on the linear predictive code obtained by linear prediction coefficient encoding section 502 and outputs to synthesis filter 504. Synthesis filter 504 constitutes a synthesis filter having the all-pole model structure based on the decoding linear predictive code obtained from linear predictive code decoding section 503.

Then, vector adder 511 adds up a vector obtained by multiplying the adaptive excitation vector selected from adaptive codebook 506 by adaptive excitation vector gain 509 and a vector obtained by multiplying the stochastic excitation vector selected from dispersed-pulse codebook 507 by stochastic excitation vector gain 510 to generate an excitation vector. Then, distortion calculation section 505 calculates distortion between the output vector when synthesis filter 504 is excited by the excitation vector and the input speech according to expression 16 below and outputs distortion ER to code identification section 512.

$$ER=\|u-(g_a Hp+g_c Hc)\|^2 \qquad \text{Expression 16}$$

where:

u: Input speech (vector)

H: Impulse response matrix of synthesis filter p: Adaptive excitation vector c: Stochastic excitation vector $g_a$: Adaptive excitation vector gain $g_c$: Stochastic excitation vector gain In expression 16, u denotes an input speech vector inside the frame being processed, H denotes an impulse response matrix of synthesis filter, ga denotes an adaptive excitation vector gain, gc denotes a stochastic excitation vector gain, p denotes an adaptive excitation vector and c denotes a stochastic excitation vector.

Here, adaptive codebook 506 is a buffer (dynamic memory) that stores excitation vectors corresponding a several number of past frames and the adaptive excitation vector selected from adaptive codebook 506 above is used to express the periodic component in the linear predictive residual vector obtained by passing the input speech through the inverse-filter of the synthesis filter.

On the other hand, the excitation vector selected from dispersed-pulse codebook 507 is used to express the non-periodic (the component obtained by removing periodic component (adaptive excitation vector component) from the linear predictive residual vector) newly added to the linear predictive residual vector in the frame actually being processed.

Adaptive excitation vector gain multiplication section 509 and stochastic excitation vector gain multiplication section 510 have the function of multiplying the adaptive excitation vector selected from adaptive codebook 506 and stochastic excitation vector selected from dispersed-pulse codebook 507 by the adaptive excitation vector gain and stochastic excitation vector gain read from gain codebook 508. Gain codebook 508 is a static memory that stores a plurality of types of sets of an adaptive excitation vector gain to be multiplied on the adaptive excitation vector and stochastic excitation vector gain to be multiplied on the stochastic excitation vector.

Code identification section 512 selects an optimal combination of indices of the three codebooks above (adaptive codebook, dispersed-pulse codebook, gain codebook) that minimizes distortion ER of expression 16 calculated by distortion calculation section 505. Then, distortion identification section 512 outputs the indices of their respective codebooks selected when the above distortion reaches a minimum to code output section 513 as adaptive excitation vector code, stochastic excitation vector code and gain code, respectively.

Finally, code output section 513 compiles the linear predictive code obtained from linear prediction coefficient encoding section 502 and the adaptive excitation vector code, stochastic excitation vector code and gain code identified by code identification section 512 into a code (bit information) that expresses the input speech inside the frame actually being processed and outputs this code to the decoder side.

By the way, code identification section 512 sometimes identifies an adaptive excitation vector code, stochastic excitation vector code and gain code on a "subframe" basis, where "subframe" is a subdivision of the processing frame. However, no distinction will be made between a frame and a subframe (will be commonly referred to as "frame") in the following explanations of the present description.

Then, an outline of the CELP speech decoder will be explained using FIG. 12.

Figure 12:
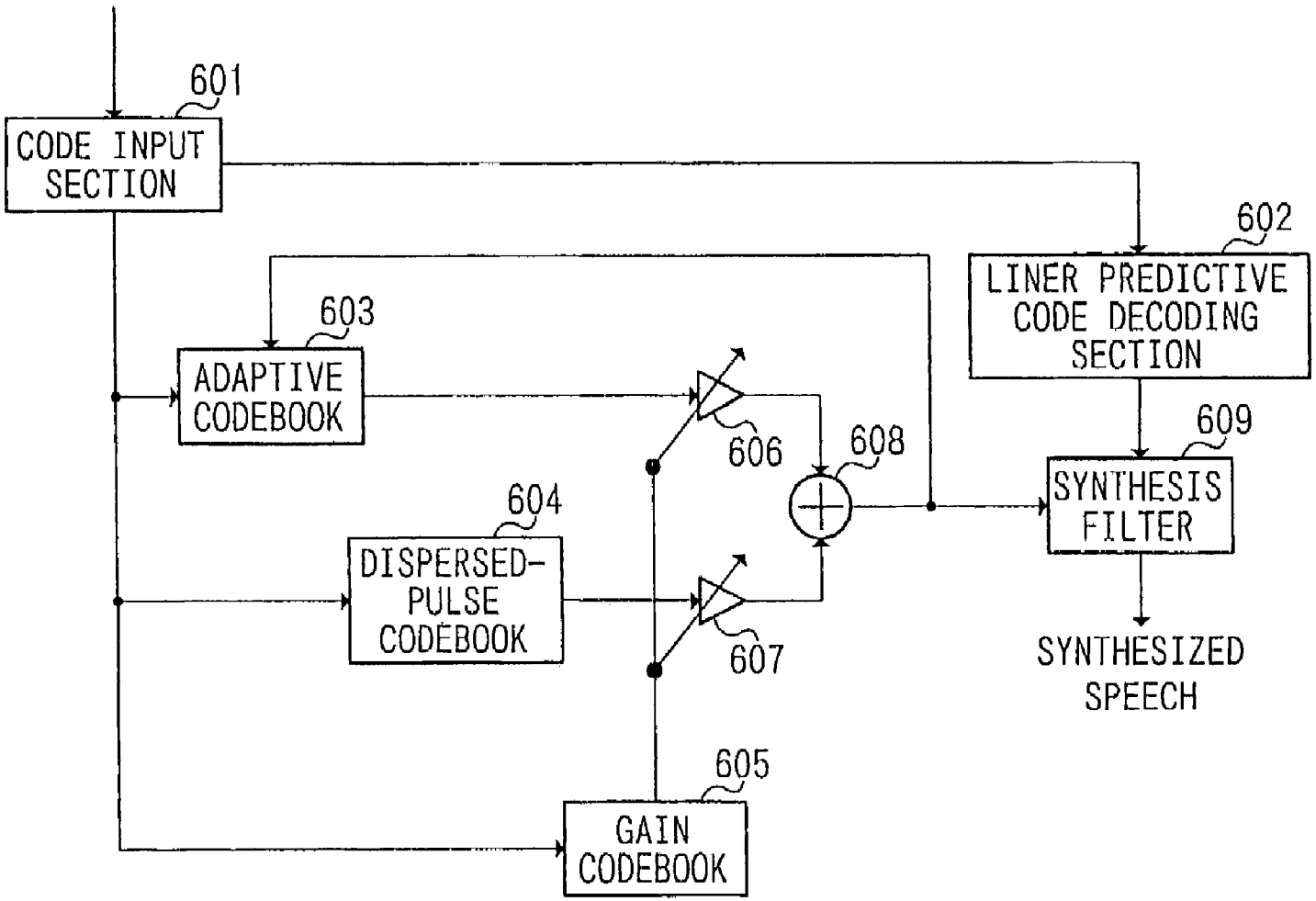
FIG. 12 is a block diagram showing a configuration of a speech decoder for decoding speech data coded by the speech coder according to Embodiment 3 of the present invention.

In the CELP decoder in FIG. 12, code input section 601 receives a code (bit information to reconstruct a speech signal on a (sub) frame basis) identified and transmitted from the CELP speech encoder (FIG. 11) and de-multiplexes the received code into 4 types of code: a linear predictive code, adaptive excitation vector code, stochastic excitation vector code and gain code. Then, code input section 601 outputs the linear predictive code to linear prediction coefficient decoding section 602, the adaptive excitation vector code to adaptive codebook 603, the stochastic excitation vector code to dispersed-pulse codebook 604 and the gain code to gain codebook 605.

Then, linear prediction coefficient decoding section 602 decodes the linear predictive code input from code input section 601, obtains a decoded linear predictive coefficients and outputs this decoded linear predictive coefficients to synthesis filter 609.

Synthesis filter 609 constructs a synthesis filter having the all-pole model structure based on the decoding linear predictive code obtained from linear predictive code decoding section 602. On the other hand, adaptive codebook 603 outputs an adaptive excitation vector corresponding to the adaptive excitation vector code input from code input section 601. Dispersed-pulse codebook 604 outputs a stochastic excitation vector corresponding to the stochastic excitation vector code input from code input section 601. Gain codebook 605 reads an adaptive excitation gain and stochastic excitation gain corresponding to the gain code input from code input section 601 and outputs these gains to adaptive excitation vector gain multiplication section 606 and stochastic excitation vector gain multiplication section 607, respectively.

Then, adaptive excitation vector gain multiplication section 606 multiplies the adaptive excitation vector output from adaptive codebook 603 by the adaptive excitation vector gain output from gain codebook 605 and stochastic excitation vector gain multiplication section 607 multiplies the stochastic excitation vector output from dispersed-pulse codebook 604 by the stochastic excitation vector gain output from gain codebook 605. Then, vector addition section 608 adds up the respective output vectors of adaptive excitation vector gain multiplication section 606 and stochastic excitation vector gain multiplication section 607 to generate an excitation vector. Then, synthesis filter 609 is excited by this excitation vector and a synthesized speech of the received frame section is output.

It is important to suppress distortion ER of expression 16 to a small value in order to obtain a synthesized speech of high quality in such a CELP-based speech encoder/speech decoder. To do this, it is desirable to identify the best combination of an adaptive excitation vector code, stochastic excitation vector code and gain code in closed-loop fashion so that ER of expression 16 is minimized. However, since attempting to identify distortion ER of expression 16 in the closed-loop fashion leads to an excessively large amount of computational complexity, it is a general practice to identify the above 3 types of code in the open-loop fashion.

More specifically, an adaptive codebook search is performed first. Here, the adaptive codebook search processing refers to processing of vector quantization of the periodic component in a predictive residual vector obtained by passing the input speech through the inverse-filter by the adaptive excitation vector output from the adaptive codebook that stores excitation vectors of the past several frames. Then, the adaptive codebook search processing identifies the entry number of the adaptive excitation vector having a periodic component close to the periodic component within the linear predictive residual vector as the adaptive excitation vector code. At the same time, the adaptive codebook search temporarily ascertains an ideal adaptive excitation vector gain.

Then, a stochastic codebook search (corresponding to dispersed-pulse codebook search in this embodiment) is performed. The dispersed-pulse codebook search refers to processing of vector quantization of the linear predictive residual vector of the frame being processed with the periodic component removed, that is, the component obtained by subtracting the adaptive excitation vector component from the linear predictive residual vector (hereinafter also referred to as "target vector for stochastic codebook search") using a plurality of stochastic excitation vector candidates generated from the dispersed-pulse codebook. Then, this dispersed-pulse codebook search processing identifies the entry number of the stochastic excitation vector that performs encoding of the target vector for stochastic codebook search with least distortion as the stochastic excitation vector code. At the same time, the dispersed-pulse codebook search temporarily ascertains an ideal stochastic excitation vector gain.

Finally, a gain codebook search is performed. The gain codebook search is processing of encoding (vector quantization) on a vector made up of 2 elements of the ideal adaptive gain temporarily obtained during the adaptive codebook search and the ideal stochastic gain temporarily obtained during the dispersed-pulse codebook search so that distortion with respect to a gain candidate vector (vector candidate made up of 2 elements of the adaptive excitation vector gain candidate and stochastic excitation vector gain candidate) stored in the gain codebook reaches a minimum. Then, the entry number of the gain candidate vector selected here is output to the code output section as the gain code.

Here, of the general code search processing above in the CELP speech encoder, the dispersed-pulse codebook search processing (processing of identifying a stochastic excitation vector code after identifying an adaptive excitation vector code) will be explained in further detail below.

As explained above, a linear predictive code and adaptive excitation vector code are already identified when a dispersed-pulse codebook search is performed in a general CELP encoder. Here, suppose an impulse response matrix of a synthesis filter made up of an already identified linear predictive code is H, an adaptive excitation vector corresponding to an adaptive excitation vector code is p and an ideal adaptive excitation vector gain (provisional value) determined simultaneously with the identification of the adaptive excitation vector code is ga. Then, distortion ER of expression 16 is modified into expression 17 below.

$$ER_k=\|v-g_cHc_k\|^2 \qquad \text{Expression 17}$$

where:

v: Target vector for stochastic codebook search (where, $v=u-g_aHp$)

$g_c$: Stochastic excitation vector gain

H: Impulse response matrix of a synthesis filter $c_k$: Stochastic excitation vector (k: entry number)

Here, vector v in expression 17 is the target vector for stochastic codebook search of expression 18 below using input speech signal u in the processing frame, impulse response matrix H (determined) of the synthesis filter, adaptive excitation vector p (determined) and ideal adaptive excitation vector gain ga (provisional value).

$$v=u-g_aHp \qquad \text{Expression 18}$$

where:

u: Input speech (vector)

$g_a$: Adaptive excitation vector gain (provisional value)

H: Impulse response matrix of a synthesis filter p: Stochastic excitation vector By the way, the stochastic excitation vector is expressed as "c" in expression 16, while the stochastic excitation vector is expressed as "ck" in expression 17. This is because expression 16 does not explicitly indicate the difference of the entry number (k) of the stochastic excitation vector, whereas expression 17 explicitly indicates the entry number. Despite the difference in expression, both are the same in meaning.

Therefore, the dispersed-pulse codebook search means the processing of determining entry number k of stochastic excitation vector ck that minimizes distortion ERk of expression 17. Moreover, when entry number k of stochastic excitation vector ck that minimizes distortion ERk of expression 17 is identified, stochastic excitation gain gc is assumed to be able to take an arbitrary value. Therefore, the processing of determining the entry number that minimizes distortion of expression 17 can be replaced with the processing of identifying entry number k of stochastic excitation vector ck that maximizes Dk of expression 10 above.

Then, the dispersed-pulse codebook search is carried out in 2 stages: distortion calculation section 505 calculates Dk of expression 10 for every entry number k of stochastic excitation vector ck, outputs the value to code identification section 512 and code identification section 512 compares the values, large and small, in expression 10 for every entry number k, determines entry number k when the value reaches a maximum as the stochastic excitation vector code and outputs to code output section 513.

The operations of the speech encoder and speech decoder according to this embodiment will be explained below.

Figure 13B:
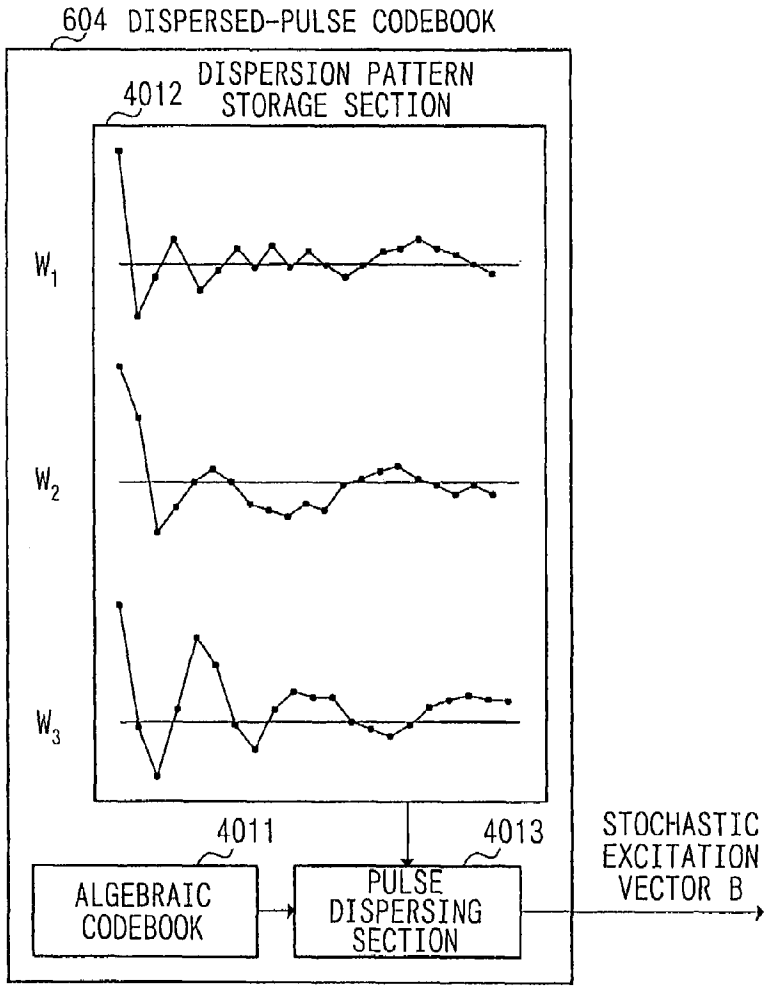
FIG. 13B illustrates an example of the dispersed-pulse codebook used in the speech decoder according to Embodiment 3 of the present invention.
Figure 13A:
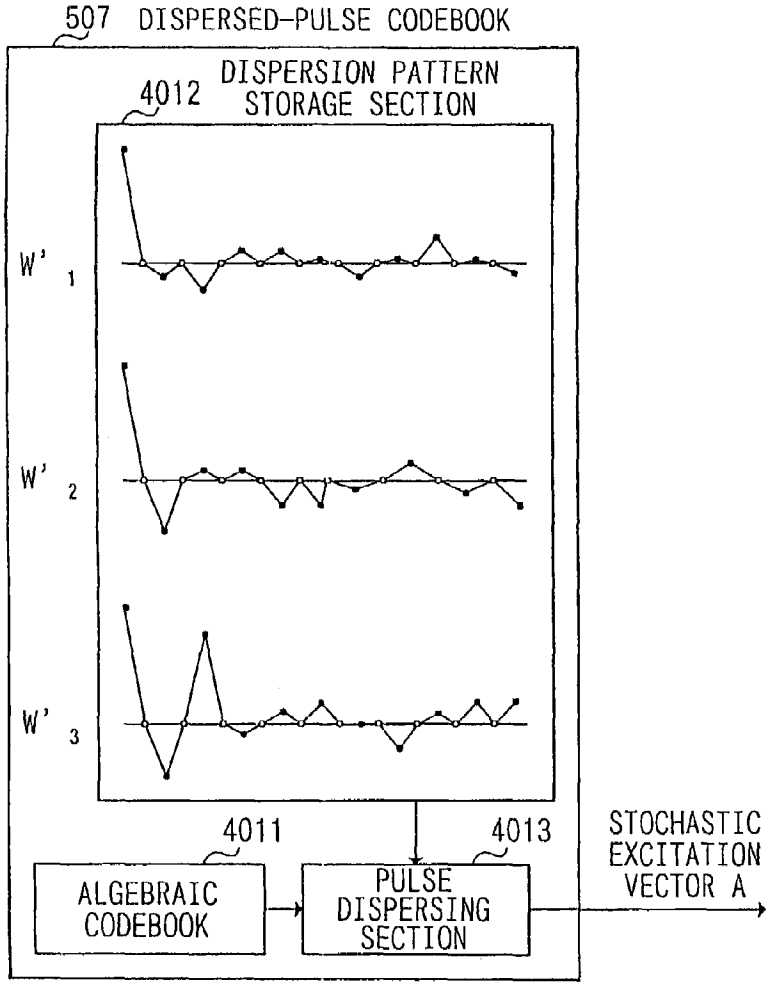
FIG. 13A illustrates an example of a dispersed-pulse codebook used in the speech encoder according to Embodiment 3 of the present invention.

FIG. 13A shows a configuration of dispersed-pulse codebook 507 in the speech encoder shown in FIG. 11 and FIG. 13B shows a configuration of dispersed-pulse codebook 604 in the speech decoder shown in FIG. 12. The difference in configuration between dispersed-pulse codebook 507 shown in FIG. 13A and dispersed-pulse codebook 604 shown in FIG. 13B is the difference in the shape of dispersion patterns registered in the dispersion pattern storage section.

In the case of the speech decoder in FIG. 13B, dispersion pattern storage section 4012 registers one type per channel of any one of (1) dispersion pattern of a shape resulting from statistical training of shapes of a huge number of target vectors for stochastic codebook search, contained in a target vector for stochastic codebook search, (2) dispersion pattern of a random-like shape to efficiently express unvoiced consonant segments and noise-like segments, (3) dispersion pattern of a pulse-like shape to efficiently express stationary voiced segments, (4) dispersion pattern of a shape that gives an effect of spreading around the energy (the energy is concentrated on the positions of non-zero elements) of an excitation vector output from the algebraic codebook, (5) dispersion pattern selected from among several arbitrarily prepared dispersion pattern candidates by repeating encoding and decoding of the speech signal and an subjective (listening) evaluation of the synthesized speech so that synthesized speech of high quality can be output and (6) dispersion pattern created based on phonological knowledge.

On the other hand, dispersion pattern storage section 4012 in the speech encoder in FIG. 13A registers dispersion patterns obtained by replacing dispersion patterns registered in dispersion pattern storage section 4012 in the speech decoder in FIG. 13B with zero for every other sample.

Then, the CELP speech encoder/speech decoder in the above configuration encodes/decodes the speech signal using the same method as described above without being aware that different dispersion patterns are registered in the encoder and decoder.

The encoder can reduce the amount of computational complexity of pre-processing during a stochastic codebook search when the dispersed-pulse codebook is used for the stochastic codebook section (can reduce by half the amount of computational complexity of $H_i=H_tW_i$ and $X_{it}=v_tH_i$), while the decoder can spread around the energy concentrated on the positions of non-zero elements by convoluted conventional dispersion patterns on pulse vectors, making it possible to improve the quality of a synthesized speech.

As shown in FIG. 13A and FIG. 13B, this embodiment describes the case where the speech encoder uses dispersion patterns obtained by replacing dispersion patterns used by the speech decoder with zero every other sample. However, this embodiment is also directly applicable to a case where the speech encoder uses dispersion patterns obtained by replacing dispersion pattern elements used by the speech decoder with zero every N(N≧1) samples, and it is possible to attain similar action in that case, too.

Furthermore, this embodiment describes the case where the dispersion pattern storage section registers dispersion patterns of one type per channel, but the present invention is also applicable to a CELP speech encoder/decoder that uses the dispersed-pulse codebook characterized by registering dispersion patterns of 2 or more types per channel and selecting and using a dispersion pattern for the stochastic codebook section, and it is possible to attain similar actions and effects in that case, too.

Furthermore, this embodiment describes the case where the dispersed-pulse codebook use an algebraic codebook that outputs a vector including 3 non-zero elements, but this embodiment is also applicable to a case where the vector output by the algebraic codebook section includes M (M≧1) non-zero elements, and it is possible to attain similar actions and effects in that case, too.

Furthermore, this embodiment describes the case where an algebraic codebook is used as the codebook for generating a pulse vector made up of a small number of non-zero elements, but this embodiment is also applicable to a case where other codebooks such as multi-pulse codebook or regular pulse codebook are used as the codebooks for generating the relevant pulse vector, and it is possible to attain similar actions and effects in that case, too.

Figure 14B:
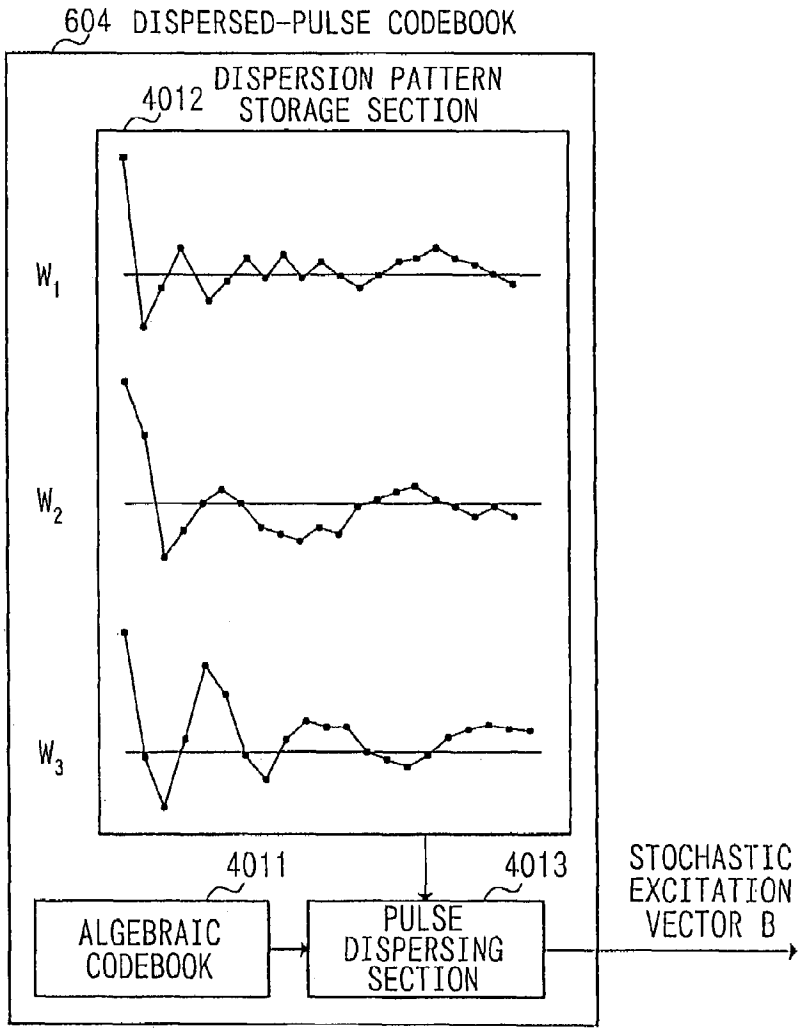
FIG. 14B illustrates an example of the dispersed-pulse codebook used in the speech decoder according to Embodiment 3 of the present invention.
Figure 14A:
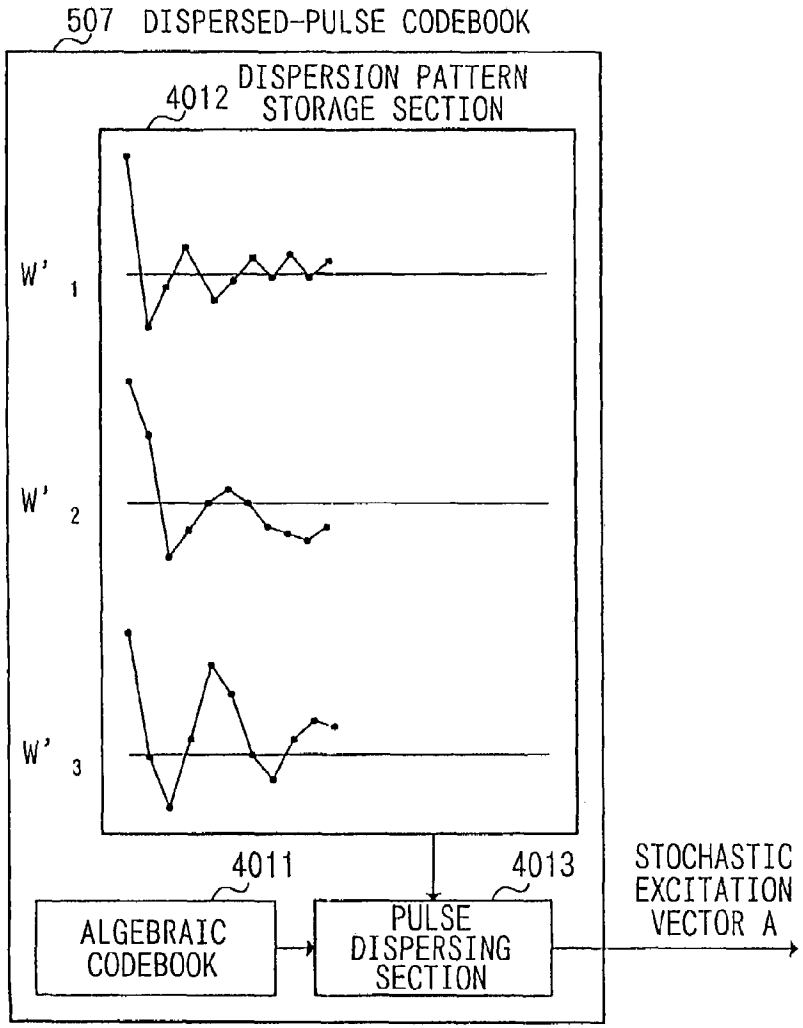
FIG. 14A illustrates an example of the dispersed-pulse codebook used in the speech encoder according to Embodiment 3 of the present invention.

Then, FIG. 14A shows a configuration of the dispersed-pulse codebook in the speech encoder in FIG. 11 and FIG. 14B shows a configuration of the dispersed-pulse codebook in the speech decoder in FIG. 12.

The difference in configuration between the dispersed-pulse codebook shown in FIG. 14A and the dispersed-pulse codebook shown in FIG. 14B is the difference in the length of dispersion patterns registered in the dispersion pattern storage section. In the case of the speech decoder in FIG. 14B, dispersion pattern storage section 4012 registers one type per channel of any one of (1) dispersion pattern of a shape resulting from statistical training of shapes based on a huge number of target vectors for stochastic codebook search, (2) dispersion pattern of a random-like shape to efficiently express unvoiced consonant segments and noise-like segments, (3) dispersion pattern of a pulse-like shape to efficiently express stationary voiced segments, (4) dispersion pattern of a shape that gives an effect of spreading around the energy (the energy is concentrated on the positions of non-zero elements) of an excitation vector output from the algebraic codebook, (5) dispersion pattern selected from among several arbitrarily prepared dispersion pattern candidates by repeating encoding and decoding of the speech signal and subjective (listening) evaluation of the synthesized speech so that synthesized speech of high quality can be output and (6) dispersion pattern created based on phonological knowledge.

On the other hand, dispersion pattern storage section 4012 in the speech encoder in FIG. 14A registers dispersion patterns obtained by truncating dispersion patterns registered in the dispersion pattern storage section in the speech decoder in FIG. 14B at a half length.

Then, the CELP speech encoder/speech decoder in the above configurations encodes/decodes the speech signal using the same method as described above without being aware that different dispersion patterns are registered in the encoder and decoder.

The coder can reduce the amount of computational complexity of pre-processing during a stochastic codebook search when the dispersed-pulse codebook is used for the stochastic codebook section (can reduce by half the amount of computational complexities of $H_i=H_tW_i$ and $X_{it}=v_tH_i$), while the decoder uses the same conventional dispersion patterns, making it possible to improve the quality of a synthesized speech.

As shown in FIG. 14A and FIG. 14B, this embodiment describes the case where the speech encoder uses dispersion patterns obtained by truncating dispersion patterns used by the speech decoder at a half length. However, when dispersion patterns used by the speech decoder are truncated at a shorter length N(N≧1), this embodiment provides an effect that it is possible to further reduce the amount of computational complexty of pre-processing during a stochastic codebook search. However, the case where dispersion patterns used by the speech encoder are truncated at a length of 1 corresponds to the speech encoder that uses no dispersion pattern (dispersion patterns are applied to the speech decoder).

Furthermore, this embodiment describes the case where the dispersion pattern storage section registers dispersion patterns of one type per channel, but the present invention is also applicable to a speech encoder/decoder that uses the dispersed-pulse codebook characterized by registering dispersion patterns of 2 or more types per channel and selecting and using a dispersion pattern for the stochastic codebook section, and it is possible to attain similar actions and effects in that case, too.

Furthermore, this embodiment describes the case where the dispersed-pulse codebook uses an algebraic codebook that outputs a vector including 3 non-zero elements, but this embodiment is also applicable to a case where the vector output by the algebraic codebook section includes M (M≧1) non-zero elements, and it is possible to attain similar actions and effects in that case, too.

Furthermore, this embodiment describes the case where the speech encoder uses dispersion patterns obtained by truncating the dispersion patterns used by the speech decoder at a half length, but it is also possible for the speech encoder to truncate the dispersion patterns used by the speech decoder at a length of N (N≧1) and further replace the truncated dispersion patterns with zero every M (M≧1) samples, and it is possible to further reduce the amount of computational complexity for the stochastic codebook search.

Thus, according to this embodiment, the CELP-based speech encoder, decoder or speech encoding/decoding system using the dispersed-pulse codebook for the stochastic codebook section registers fixed waveforms frequently included in target vectors for stochastic codebook-search acquired by statistical training as dispersion vectors, convolutes (reflects) these dispersion patterns on pulse vectors, and can thereby use stochastic excitation vectors, which is closer to the actual target vectors for stochastic codebook search, providing advantageous effects such as allowing the decoding side to improve the quality of synthesized speech while allowing the encoding side to suppress the amount of computational complexity for the stochastic codebook search, which is sometimes problematic when the dispersed-pulse codebook is used for the stochastic codebook section, to a lower level than conventional arts.

This embodiment can also attain similar actions and effects in the case where other codebooks such as multi-pulse codebook or regular pulse codebook, etc. are used as the codebooks for generating pulse vectors made up of a small number of non-zero elements.

The speech encoding/decoding according to Embodiments 1 to 3 above are described as the speech encoder/speech decoder, but this speech encoding/decoding can also be implemented by software. For example, it is also possible to store a program of speech encoding/decoding described above in ROM and implement encoding/decoding under the instructions from a CPU according to the program. It is further possible to store the program, adaptive codebook and stochastic codebook (dispersed-pulse codebook) in a computer-readable recording medium, record the program, adaptive codebook and stochastic codebook (dispersed-pulse codebook) of this recording medium in RAM of the computer and implement encoding/decoding according to the program. In this case, it is also possible to attain similar actions and effects to those in Embodiments 1 to 3 above. Moreover, it is also possible to download the program in Embodiments 1 to 3 above through a communication terminal and allow this communication terminal to run the program.

Embodiments 1 to 3 can be implemented individually or combined with one another.

This application is based on the Japanese Patent Application No.HEI 11-235050 filed on Aug. 23, 1999, the Japanese Patent Application No.HEI 11-236728 filed on Aug. 24, 1999 and the Japanese Patent Application No.HEI 11-248363 filed on Sep. 2, 1999, entire content of which is expressly incorporated by reference herein.

INDUSTRIAL APPLICABILITY

The present invention is applicable to a base station apparatus or communication terminal apparatus in a digital communication system.

The invention claimed is:

1. A speech encoder comprising:

an LPC synthesizer that obtains synthesized speech by filtering an adaptive excitation vector and a stochastic excitation vector stored in an adaptive codebook and in a stochastic codebook using LPC coefficients obtained from input speech;

a gain calculator that calculates gains of said adaptive excitation vector and said stochastic excitation vector and searches code of the adaptive excitation vector and code of the stochastic excitation vector by comparing distortions between said input speech and said synthesized speech obtained using said adaptive excitation vector and said stochastic excitation vector; and a parameter coder that performs predictive coding of gains using said adaptive excitation vector and said stochastic excitation vector corresponding to the codes obtained, wherein said parameter coder comprises a prediction coefficient adjuster that adjusts at least one prediction coefficient used for said predictive coding according to at least one state of at least one previous subframe.

2. The speech encoder according to claim 1, wherein when at least one state of a previous subframe is one of an extremely large value and an extremely small value, said prediction coefficient adjuster adjusts said predictive coefficients so as to reduce the influence thereof.

3. The speech encoder according to claim 1, wherein said parameter coder comprises a codebook including gain vectors of the adaptive excitation vectors, logarithmic gain vectors of the stochastic excitation vectors and coefficients for adjusting the prediction coefficient.

4. The speech encoder according to claim 3, wherein, in predictive coding, when a product sum between states and prediction coefficients is calculated, prediction coefficient adjustment coefficients corresponding to the states are multiplied.

5. The speech encoder according to claim 1, further comprising a storage that stores said adaptive excitation vector, said stochastic excitation vector and prediction coefficient adjustment coefficients in accordance with each state.

6. The speech encoder according to claim 5, wherein when said adaptive excitation vector and said stochastic excitation vector stored in said storage are updated, said prediction coefficient adjustment coefficients are also updated.

* * * * *